US009768510B2

(12) United States Patent
Tanaka et al.

(10) Patent No.: US 9,768,510 B2
(45) Date of Patent: Sep. 19, 2017

(54) ANTENNA DEVICE AND MANUFACTURING METHOD OF ANTENNA DEVICE

(71) Applicant: Sumida Corporation, Chuo-ku, Tokyo (JP)

(72) Inventors: Kei Tanaka, Natori (JP); Takanobu Rokuka, Natori (JP); Hitoshi Moriya, Natori (JP); Shigeru Mahara, Natori (JP); Noriaki Iwasaki, Natori (JP); Masakazu Fukuoka, Natori (JP); Yoshinori Miura, Natori (JP)

(73) Assignee: SUMIDA CORPORATION (JP)

( * ) Notice: Subject to any disclaimer, the term of this patent is extended or adjusted under 35 U.S.C. 154(b) by 142 days.

(21) Appl. No.: 14/685,963

(22) Filed: Apr. 14, 2015

(65) Prior Publication Data

US 2015/0295315 A1 Oct. 15, 2015

(30) Foreign Application Priority Data

Apr. 15, 2014 (JP) ..... 2014-083734

(51) Int. Cl.

| | |
|---|---|
| ***H01Q 7/00*** | (2006.01) |
| ***H01Q 7/08*** | (2006.01) |
| ***H01Q 1/32*** | (2006.01) |
| *H01Q 1/22* | (2006.01) |
| *H01F 17/04* | (2006.01) |

(52) U.S. Cl.
CPC ..... *H01Q 7/08* (2013.01); *H01Q 1/3241* (2013.01); *H01F 17/04* (2013.01); *H01Q 1/22* (2013.01); *H01Q 7/00* (2013.01)

(58) Field of Classification Search
USPC ..... 343/788, 870; 336/221
See application file for complete search history.

(56) References Cited

U.S. PATENT DOCUMENTS

2012/0176215 A1* 7/2012 Kudo ..... H01F 27/34 336/221

FOREIGN PATENT DOCUMENTS

JP 2010-081088 A 4/2010

* cited by examiner

*Primary Examiner* — Jessica Han
*Assistant Examiner* — Hai Tran
(74) *Attorney, Agent, or Firm* — Harness, Dickey & Pierce, P.L.C.

(57) ABSTRACT

There are included a core 20 formed from a magnetic material; a terminal mounting unit 80 arranged on one end portion side of core 20; a coil 40 which is arranged on the outer circumferential side of core 20 and concurrently which is formed by winding a conductive wire 41; and a plurality of terminal members 70 which are mounted on terminal mounting unit and concurrently which are electrically connected with a terminal end of conductive wire 41 or with an electronic component at any position, wherein at terminal mounting unit 80, there are provided a plurality of mounting grooves 81 for plugging-in terminal members 70.

15 Claims, 19 Drawing Sheets

ANTENNA DEVICE AND MANUFACTURING METHOD OF ANTENNA DEVICE

CROSS REFERENCE TO RELATED APPLICATIONS

The present invention contains subject matter related to Japanese Patent Application No. 2014-083734 filed in the Japanese Patent Office on Apr. 15, 2014, the entire contents of which are incorporated herein by reference.

BACKGROUND OF THE INVENTION

Field of the Invention

The present invention relates to an antenna device and a manufacturing method of an antenna device.

Description of the Related Art

In recent years, with regard to vehicles, the number thereof has been increasing in which there are mounted antenna devices for receiving signals for carrying out locking and unlocking of the doors. For such antenna devices, there is, for example, an antenna disclosed in a Patent Document 1 (Japanese unexamined patent publication No. 2010-081088). The antenna device disclosed in the Patent Document 1 is constituted such that it has a constitution in which a coil is wound around a bar-shaped magnetic core. In order to manufacture such an antenna device, a hoop obtained by forming a metal plate in a predetermined shape by pressing or the like is arranged inside a mold and after the arrangement thereof, there is employed an insert-molding for filling a filling-member such as a resin or the like. According to such an insert-molding, a hoop which will become a terminal and a resin base are formed integrally.

In addition, in the constitution disclosed in the Patent Document 1, a case for covering the outer circumference of aforesaid core is formed by applying a mold-forming after winding a coil around the outer circumferential surface of the magnetic core.

SUMMARY OF THE INVENTION

Incidentally, in case of employing an insert-molding such as disclosed in the Patent Document 1, it is necessary to form a hoop having a predetermined shape before the insert-molding thereof. In case of forming such a hoop, metal plates or a lot of portions will be cut out and it becomes a state in which a lot of portions that become useless will occur for the metal plate which is the material thereof. In addition, in order to form a hoop having a predetermined shape, it becomes also necessary to prepare a dedicated press die.

In addition, in case of setting the hoop in the inside of a mold for injection-molding and carrying out the insert-molding, it is necessary to fix the hoop at a predetermined position inside the mold. Further, for the portion exposing from the mold for injection-molding within the hoop, it is necessary to take measures to block resins which will be filled corresponding to the portion thereof, so that it becomes a state in which the structure of the mold becomes complicated and also the cost will rise owing to the configuration thereof.

The present invention was invented in view of such a problem and is addressed to provide an antenna device and a manufacturing method of an antenna device in which it is possible to mount a terminal member easily without employing an insert-molding.

One aspect of an antenna device of the present invention has a feature in which there are included: a core formed from a magnetic material; a terminal mounting unit arranged on one end portion side of the core; a coil which is arranged on the outer circumferential side of the core and concurrently which is formed by winding a conductive wire; and a plurality of terminal members which are mounted on the terminal mounting unit and concurrently which are electrically connected with a terminal end of the conductive wire or with an electronic component at any position, wherein at the terminal mounting unit, there are provided a plurality of terminal plugging-in units for plugging-in the terminal members.

Also, in addition to the above-mentioned invention, it is preferable that another aspect of the present invention further provides an antenna device further including: a winding-frame portion which is integrally molded with the terminal mounting unit; wherein the core is inserted into an internal insertion-hole of this winding-frame portion and the coil is arranged on the outer circumferential side of this winding-frame portion.

Further, in addition to the above-mentioned inventions, it is preferable that another aspect of the present invention further provides an antenna device in which terminal plugging-in units are provided by extending in concave shapes and concurrently are mounting grooves for extending the terminal members from the edge portions in the extending direction thereof, and at least one of the plurality of mounting grooves is crossing others of the mounting grooves.

Also, in addition to the above-mentioned inventions, it is preferable that another aspect of the present invention further provides an antenna device in which for the mounting grooves, there are provided a plurality of mounting vertical-grooves which pass through the terminal mounting units along the width direction of the terminal mounting units and a plurality of mounting horizontal-grooves which extend along a direction crossing the width direction of the terminal mounting unit.

Further, in addition to the above-mentioned inventions, it is preferable that another aspect of the present invention further provides an antenna device in which the mounting vertical-grooves and the mounting horizontal-grooves cross in an orthogonal state.

Also, in addition to the above-mentioned inventions, it is preferable that another aspect of the present invention further provides an antenna device in which for at least one of the positions at which the mounting grooves mutually cross, there is provided a curved portion corresponding to the bending-shape of the terminal member.

Further, in addition to the above-mentioned inventions, it is preferable that another aspect of the present invention further provides an antenna device in which with regard to two members within the plurality of terminal members, one side thereof is a user terminal connected to another device and concurrently, the other side thereof is a binding terminal portion around which a terminal end of the conductive wire is bound.

Also, in addition to the above-mentioned inventions, it is preferable that another aspect of the present invention further provides an antenna device in which the terminal plugging-in unit is a terminal insertion hole covering the outer circumference of the terminal member and the terminal member is inserted thereinto in a state that one end side and other end side of the terminal member extend from that terminal insertion hole.

Further, in addition to the above-mentioned inventions, it is preferable that another aspect of the present invention further provides an antenna device in which at the terminal mounting unit, there is provided an opening portion penetrating the terminal mounting unit, and concurrently, in which at the opening portion, there is arranged a chip capacitor of surface-mounted type, and in which at the terminal member, there is provided a wide support portion which supports the chip capacitor and concurrently which is wider compared with the distal end side for the plug-in into the terminal insertion hole.

In addition, one aspect of a manufacturing method of an antenna device has a feature in which there are included steps of: forming a coil by winding a conductive wire around a periphery of a core which is formed from a magnetic material; and mounting terminal members, which are electrically connected with a terminal end of the conductive wire or an electronic component, onto a terminal mounting unit arranged on the end portion side of the core before or after the step of forming a coil, wherein at the terminal mounting unit, there are provided a plurality of terminal plugging-in units for plugging-in the terminal members, and wherein in the step of mounting terminal members, the terminal members are plugged-in into the terminal plugging-in units.

Also, in addition to the above-mentioned invention, it is preferable that another aspect of the present invention further provides a manufacturing method of an antenna device including a step of binding a terminal end of the conductive wire at binding terminal portions which exist on the other sides of at least two of the terminal members within the plurality of terminal members after the step of forming a coil and the step of mounting terminal members.

Also, in addition to the above-mentioned inventions, it is preferable that another aspect of the present invention further provides a manufacturing method of an antenna device including a step of cutting at least one of the terminal members with a predetermined length after plugging-in the plurality of terminal members into the terminal plugging-in units after the step of mounting terminal members.

According to the present invention, it becomes possible to mount a terminal member easily without employing an insert-molding.

DESCRIPTION OF THE PREFERRED EMBODIMENTS

Hereinafter, an antenna device 10 relating to one exemplified embodiment of the present invention will be explained with reference to the drawings. It should be noted in the explanation below that also the manufacturing method of the antenna device 10 will be explained appropriately in the structural explanation thereof.

In addition, in the explanation hereinafter, there are sometimes cases in which the explanation is carried out by using XYZ orthogonal coordinate system. In those cases, the X-direction is made to indicate a longitudinal direction of the antenna device 10 in which X1 side thereof is made to be the side on which a terminal member 70, which will be explained later, is mounted and X2 side thereof is made to be the opposite side with respect thereto. In addition, the Z-direction is made to indicate a thickness direction of the antenna device 10 in which Z1 side thereof is made to be the upper side in FIG. 2 and Z2 side thereof is made to be the lower side in FIG. 2. In addition, the Y-direction is made to indicate a direction (width direction) perpendicular to the XZ-directions in which Y1 side thereof is made to be the right-near side in FIG. 1 and Y2 side thereof is made to be the opposite rear-left side with respect thereto.

<With Regard to the Whole Constitution of Antenna Device 10>

Figure 1:
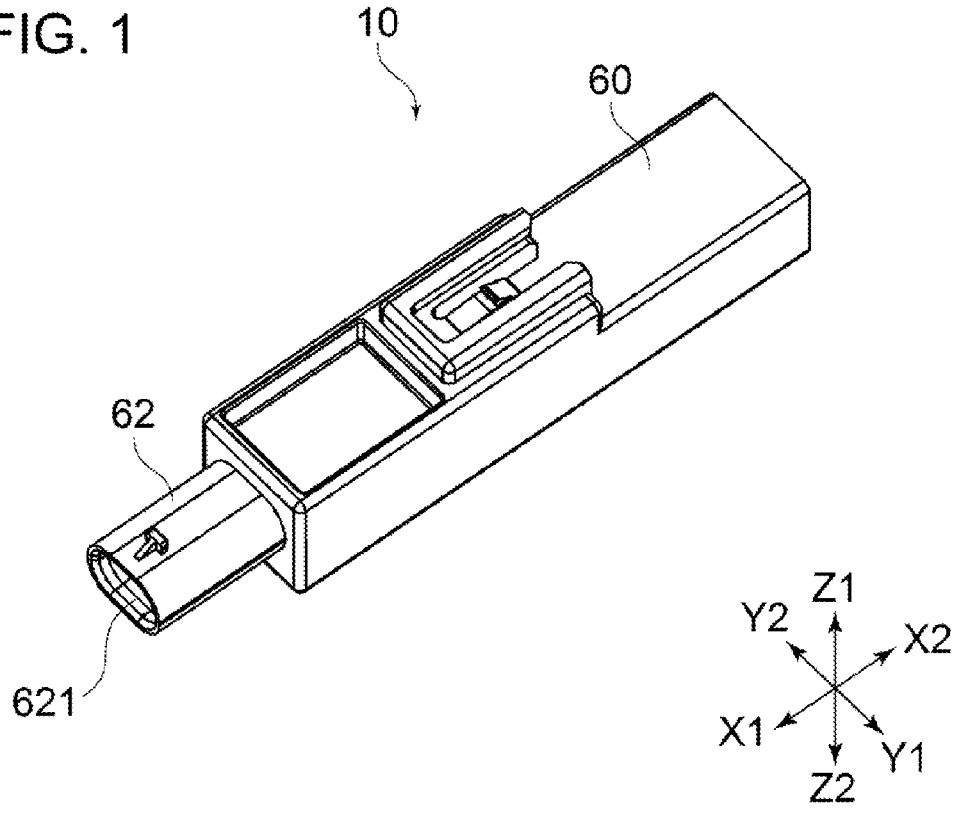
FIG. 1 is a perspective view showing a whole constitution of an antenna device relating to one exemplified embodiment of the present invention.
Figure 2:
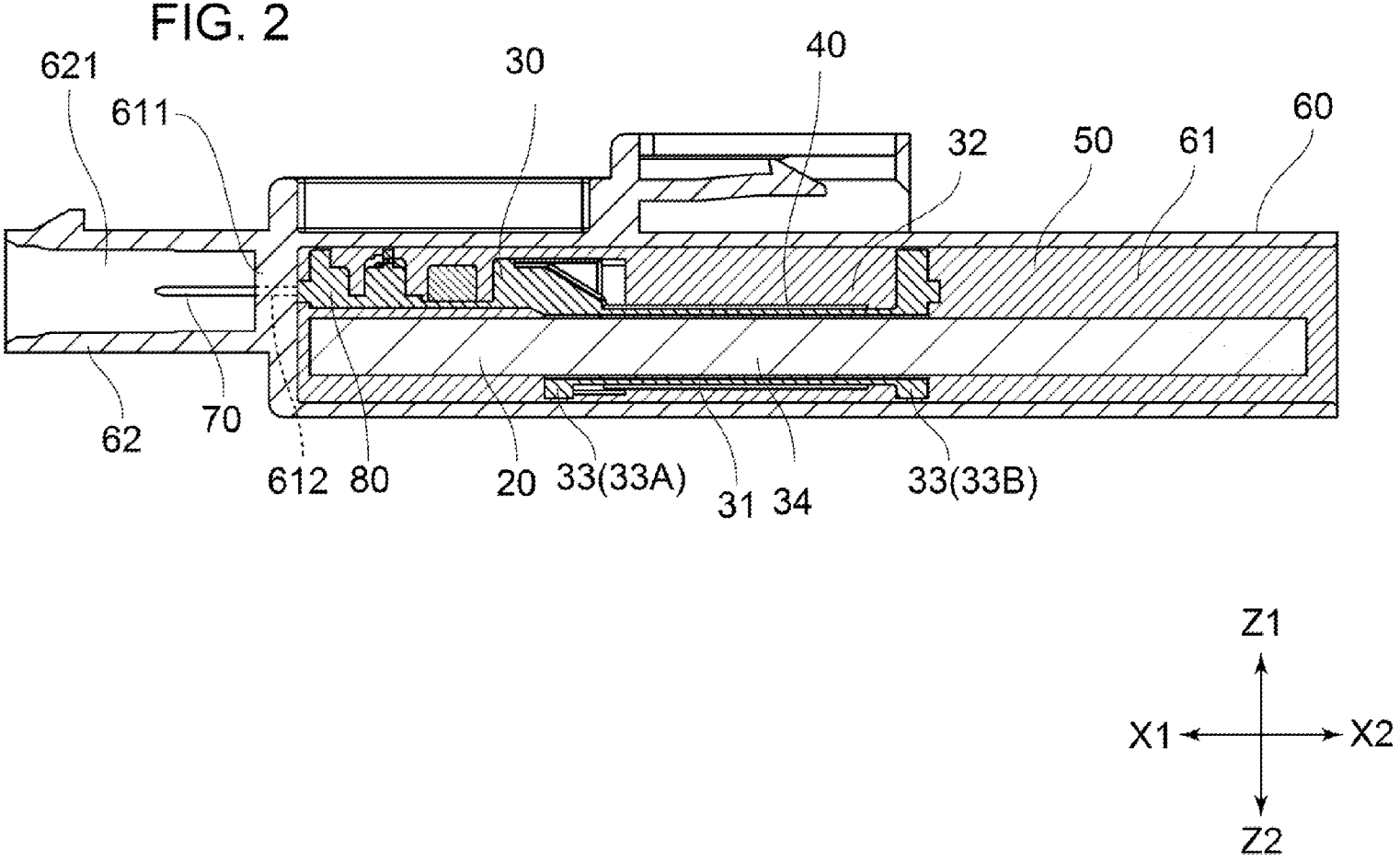
FIG. 2 is a cross-sectional side view showing a constitution of the antenna device of FIG. 1.

FIG. 1 is a perspective view showing a whole constitution of an antenna device 10. FIG. 2 is a cross-sectional side view showing a constitution of the antenna device 10. As shown in FIGS. 1 and 2, the antenna device 10 includes a core 20, a base 30, a coil 40, a resin-filling portion 50, a case 60 and a terminal member 70 as the main constituent elements thereof.

As shown in FIG. 2, the core 20 is formed from a magnetic material and concurrently is provided in a lengthy shape (bar-shape) which is long toward the X-direction. In addition, with regard to the core 20, the cross-section thereof is made to be in a rectangular shape when seen from the front side. It should be noted with regard to the core 20 that the material thereof is made to be a magnetic material, in which for the magnetic material, it is possible to use wide variety of magnetic materials and mixtures of wide variety of magnetic materials such as, for example, various kinds of ferrites of nickel-based ferrite, manganese-based ferrite and the like; permalloy; sendust; and the like.

Figure 3:
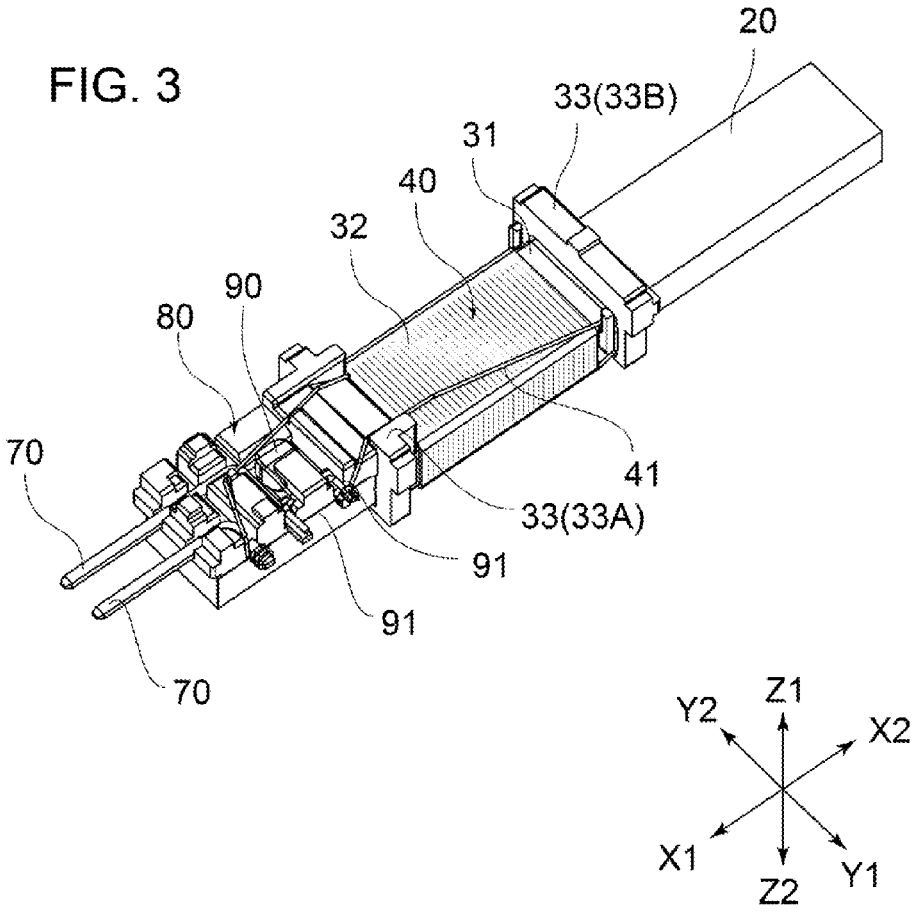
FIG. 3 is a perspective view showing a state of removing a resin-filling portion and a case from the antenna device of FIG. 1.

FIG. 3 is a perspective view showing a state of removing the resin-filling portion 50 and the case 60 from the antenna device 10. As shown in FIGS. 2 and 3, the base 30 is mounted on the outer circumferential side of the core 20. In other words, the core 20 is inserted into an internal insertion-hole 34 of the base 30. With regard to the base 30, it is preferable to form the material thereof from a thermoplastic resin or a thermosetting resin which is excellent in isolation-property and in view of a matter that there is a case in which a heat damage may occur caused by soldering, by a welding process or the like, it is more preferable to use a heat resistant resin.

Figure 4:
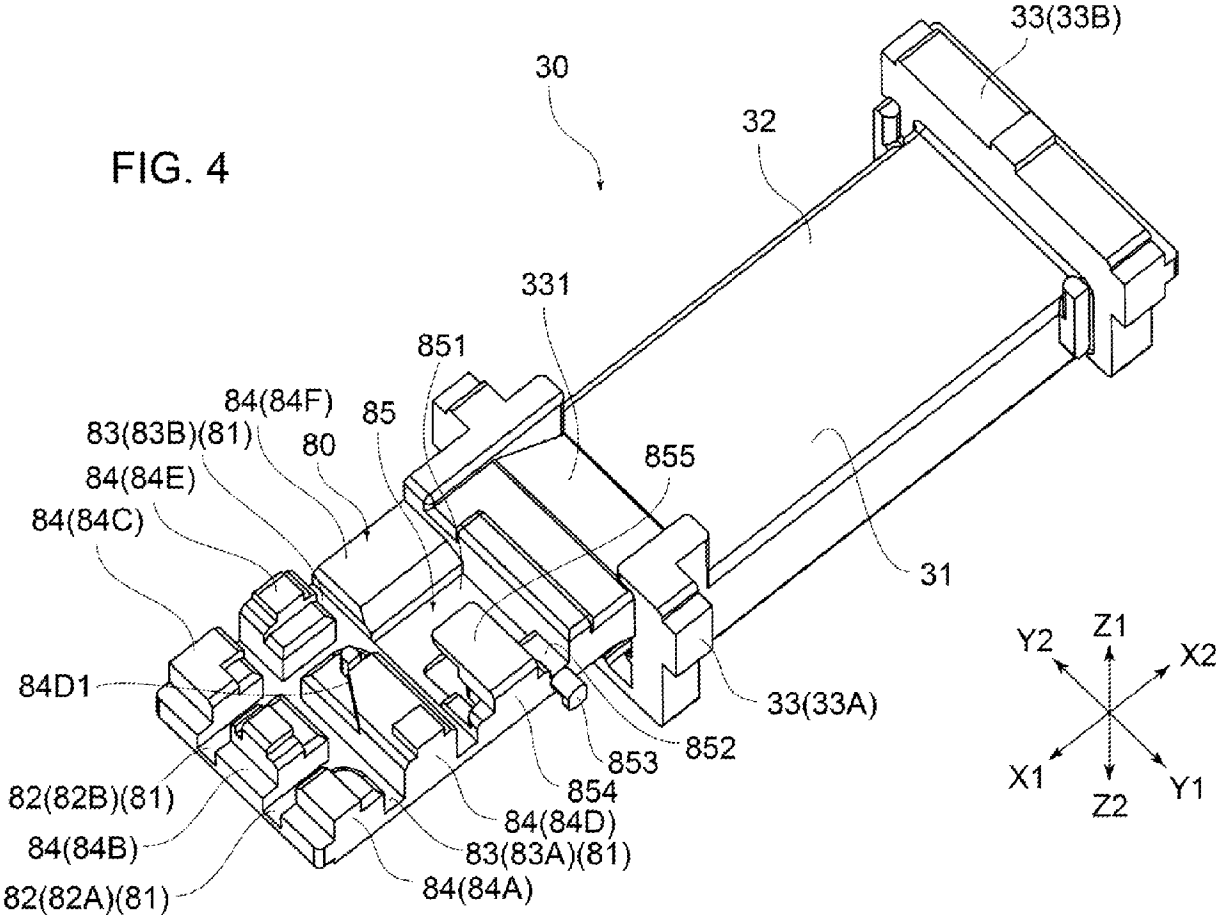
FIG. 4 is a perspective view showing a constitution of a base within the antenna device FIG. 1.

FIG. 4 is a perspective view showing a constitution of the base 30. As shown in FIG. 4, the base 30 includes a cylinder portion 31 and for the cylinder portion 31, there are provided a winding-frame unit 32 and a supporting flange portion 33. In addition, for the cylinder portion 31, there is provided an internal insertion-hole 34 and the core 20 is inserted into that internal insertion-hole 34. In addition, the base 30 also includes a terminal mounting unit 80.

The winding-frame portion 32 is a portion which is directly mounted on the core 20 within the base 30. More specifically, the winding-frame portion 32 is directly in contact with the core 20 by way of the inner wall side thereof. It should be noted that it is preferable for the inner wall of the winding-frame portion 32 to provide a rib or the like (which is not shown) for supporting the core 20.

In addition, as shown in FIGS. 2 and 3, the coil 40 is formed on the outer circumferential side of the winding-frame portion 32 by winding a conductive wire 41 there-around (this Winding-Process corresponds to Coil-Forming-Process). In addition, the supporting flange portions 33 are provided on both the end sides in the longitudinal direction (X-direction) within the winding-frame portion 32. The supporting flange portions 33 are flange-shaped portions which protrude toward the inner wall side of the case 60 within the base 30. More specifically, the supporting flange portions 33 are provided so as to protrude toward the width direction (Y-direction) and toward the up and down direction (Z-direction) compared with the winding-frame portion 32. Then, through these supporting flange portions 33, the base 30 is supported inside a plug-in hole 61 of the case 60.

In addition, a guide slope 331 is provided at a supporting flange portion 33A which is positioned on one end side (X1 side) within the pair of supporting flange portions 33. The guide slope 331 is an inclined portion which is inclined so as to be gradually directed to the upper side (Z1 side) as going from the winding-frame portion 32 toward the one end side (X1 side). Owing to the existence of such a guide slope 331, it becomes easy to guide the conductive wire 41 which is directed from the coil 40 to the terminal member 70.

In addition, also a terminal mounting unit 80 is provided on the base 30. It is allowed for the terminal mounting unit 80 to be provided integrally with the cylinder portion 31 described above, but it is also allowed to employ a constitution in which the unit is combined therewith after being formed separately. More specifically, it is allowed for the terminal mounting unit 80 to be integrally formed or not to be integrally formed with the cylinder portion 31 only if the unit is arranged on the end portion side of the core 2. It should be noted that the description with regard to the detailed constitution of the terminal mounting unit 80 will be carried out later.

In addition, inside the plug-in hole 61 of the case 60, there is provided a resin-filling portion 50. The resin-filling portion 50 is a portion formed by filling a resin in the inside of the plug-in hole 61 and owing to the configuration thereof, the inside of the plug-in hole 61 is sealed. In addition, owing to the existence of the resin-filling portion 50, the base 30 is reliably held inside the plug-in hole 61 without wobbling. Then, owing to the case 60 and the resin-filling portion 50, it is possible to heighten the waterproof effect for the antenna device 10 furthermore. In the constitution shown in FIG. 2, the resin-filling portion 50 is provided so as to fill the internal space of the case 60.

However, it is allowed to employ a configuration in which the resin-filling portion 50 does not cover the coil 40. In this case, for example, it is enough if the resin-filling portion 50 seals only the opening portion of the plug-in hole 61. In particular, in a case in which the terminal mounting unit 80 is positioned in the vicinity of the opening portion of the plug-in hole 61, it is preferable to fill this opening portion and the up and down spaces of the terminal mounting unit 80 at the same time with the resin-filling portion 50. At that time, the terminal member 70 which is plugged-in into the terminal mounting unit 80 is fixed more strongly by this resin-filling portion 50 and it is possible to reduce the wobbling when connected to an external connector on the user side. It should be noted that in a case in which the terminal mounting unit 80 is not positioned in the vicinity of the opening portion of the plug-in hole 61, it is also possible to seal the terminal mounting unit 80 and the opening portion of the plug-in hole 61 respectively by being divided into twice procedures (or more procedures if desirable) by using the resin-filling portion 50.

The case 60 is a member which covers the core 20, the base 30, the coil 40 and the resin-filling portion 50. For this case 60, there is provided the plug-in hole 61 which extends in the longitudinal direction (X-direction). The plug-in hole 61 is provided to be long such that it becomes possible to make the whole of the core 20, the base 30 and the resin-filling portion 50 enter thereinto. It should be noted that one end side (X1 side) within the plug-in hole 61 is closed by a blockage wall 611, in which for this blockage wall 611, there are provided terminal insertion holes 612 for protruding the terminal members 70, which will be explained later, into a connector hole 621. Here, it is constituted such that in a state of inserting the terminal members 70 into the terminal insertion holes 612, it is difficult for water or the like to enter into the plug-in hole 61.

In addition, for the case 60, there is provided a connector connecting portion 62. The connector connecting portion 62 includes the connector hole 621 and this connector hole 621 is formed as a bottomed hole caused by the existence of the blockage wall 611. Therefore, inside the connector hole 621, the terminal members 70 protrude through the terminal insertion holes 612. Then, when an external connector is plugged-in into the connector hole 621, the aforesaid connector and the terminal member 70 are connected electrically, in which it is constituted such that it is possible to conduct electric current through the coil 40.

<With Regard to Detailed Constitution of Terminal Mounting Unit 80>

Figure 5:
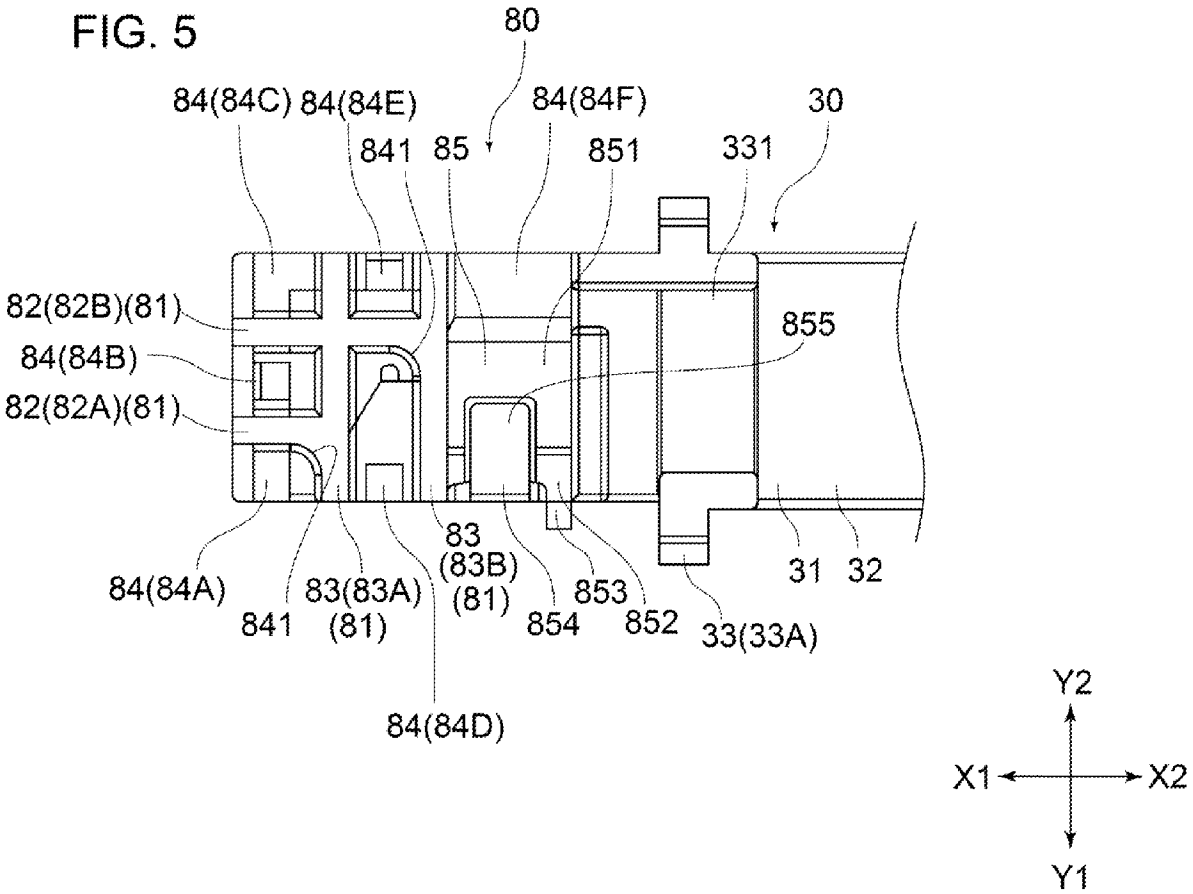
FIG. 5 is a plan view showing a constitution of a terminal mounting unit by being enlarged within the antenna device FIG. 1.
Figure 6:
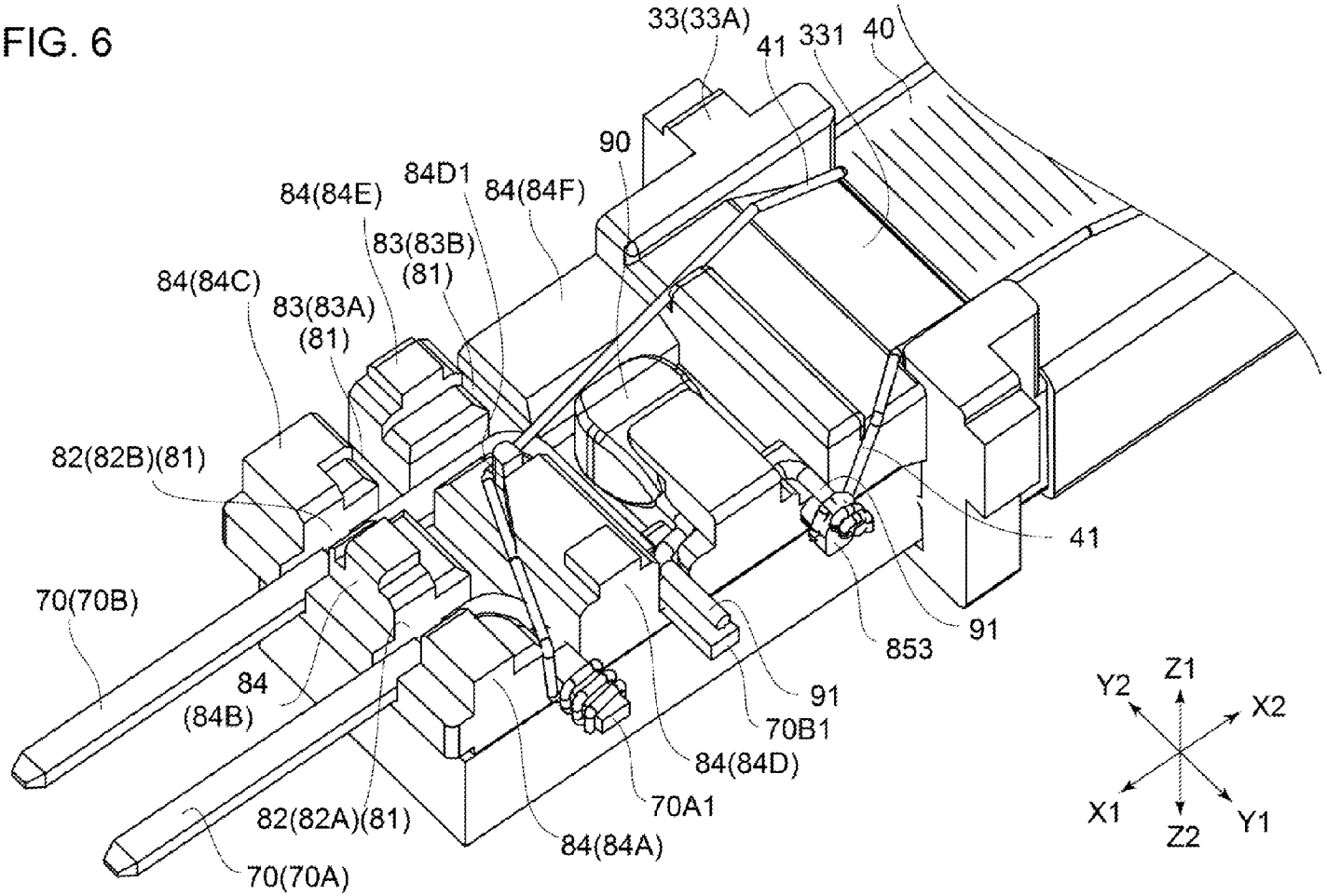
FIG. 6 is a perspective view showing a state of mounting a terminal member onto a terminal mounting unit within the antenna device of FIG. 1.

Subsequently, there will be explained a detailed constitution of the terminal mounting unit 80 described above. FIG. 5 is a plan view showing a constitution of the terminal mounting unit 80 by being enlarged. FIG. 6 is a perspective view showing a state of mounting the terminal member 70 on the terminal mounting unit 80.

As shown in FIG. 2, the terminal mounting unit 80 is arranged by being adjacently faced with respect to the core 20, but is not in contact therewith. However, it is allowed to employ such a constitution in which the terminal mounting unit 80 is in contact with the core 20. The terminal mounting unit 80 extends as far as the farthest one end side (X1 side: equivalent position as one end portion of core 20) within the base 30.

As shown in FIGS. 4 to 6, the terminal mounting unit 80 is provided with a plurality of mounting grooves 81 which correspond to the terminal plugging-in units. Supposing that the longitudinal direction (X-direction) of the antenna device 10 is made to be horizontal direction and the short-length direction (Y-direction: width direction) of the antenna device 10 is made to be vertical direction, for the mounting groove 81 in the present specification, there exist the mounting horizontal-groove 82 along the X-direction and the mounting vertical-groove 83 along the Y-direction. In the constitutions shown in FIGS. 4 to 6, the mounting horizontal-groove 82 exists as total two grooves and concurrently, the mounting vertical-groove 83 exists as total two grooves. In the explanation hereinafter, the mounting horizontal-groove 82 positioned on the near side (Y1 side) is named as a first mounting horizontal-groove 82A and the mounting horizontal-groove 82 existing on the rear side (Y2 side) is named as a second mounting horizontal-groove 82B. In addition, the mounting vertical-groove 83 existing on one end side (X1 side) is named as a first mounting vertical-groove 83A and concurrently, the mounting vertical-groove 83 existing on the other end side (X2 side) is named as a second mounting vertical-groove 83B.

As shown in FIG. 4, these mounting grooves 81 are provided in concave shapes, each of which is recessed as long as a predetermined length from the upper surface of the terminal mounting unit 80.

In addition, each of the mounting grooves 81 is provided to have a width of same degree. Then, as shown in FIG. 4, the respective bottom portions of the mounting grooves 81 are provided so as to exist on the same plane. Owing to this configuration, when mounting the terminal members 70 onto the mounting grooves 81 (see FIG. 3), it is possible to suppress a phenomenon in which the terminal members 70 are inclined unnecessarily, wobble and so on.

In the present exemplified embodiment, the mounting horizontal-grooves 82 and the mounting vertical-grooves 83 are provided so as to be mutually orthogonal. However, it is allowed for the mounting horizontal-grooves 82 and the mounting vertical-grooves 83 to cross in a state of not mutually orthogonal. In addition, in the constitution shown in FIG. 4, the first mounting horizontal-groove 82A is provided to become shortest and does not cross the second mounting vertical-groove 83B positioned on the other end side (X2 side). However, it is allowed to employ a configuration in which also the first mounting horizontal-groove 82A crosses the second mounting vertical-groove 83B.

In addition, as shown in FIG. 4, caused by being surrounded with these mounting grooves 81, there are formed a plurality of blocks 84 for the terminal mounting unit 80. Hereinafter, the block 84 on the one end side in the longitudinal direction (X-direction) and also on the near side (Y1 side) in the width direction (Y-direction) is named as a first block 84A, the block 84 which is adjacent with respect to that first block 84A on the rear side (Y2 side) is named as a second block 84B and further, the block 84 which is adjacent with respect to the second block 84B on the rear side (Y2 side) is named as a third block 84C.

In addition, the block 84 which is adjacent with respect to the first block 84A and the second block 84B on the other end side (X2 side) in the longitudinal direction (X-direction) is named as a fourth block 84D, and the block 84 which is adjacent with respect to that fourth block 84D on the rear side (Y2 side) is named as a fifth block 84E. It should be noted that the fourth block 84D is provided to be long compared with other blocks 84. However, it is allowed to employ a configuration of dividing the fourth block 84D so as to have a similar length as other blocks 84. In addition, the block 84 on the other end side (X2 side) in the longitudinal direction (X-direction) and also on the rear side (Y2 side) is named as a sixth block 84F. The sixth block 84F is arranged to reach the abutment-position of the second mounting horizontal-groove 82B in order to change the extending direction of the terminal member 70.

Here, in the constitutions shown in FIGS. 4 and 5, there are provided curved portions 841 respectively for the first block 84A and the fourth block 84D. The curved portion 841 is a portion corresponding to the bending of the terminal member 70, in which it becomes possible for the terminal member 70, which is bent, for example, in an L-shape, to easily be plugged-in into the mounting groove 81 depending on the existence of this curved portion 841. In FIGS. 4 and 5, the curved portions 841 are provided for the first block 84A and the fourth block 84D which become necessary minimally when considering the plug-in configurations of the terminal members 70. However, it is allowed to employ a constitution in which the curved portion 841 is provided for other respective blocks 84. It should be noted in the constitutions shown in FIGS. 4 and 5 that the curved portions 841 are provided at the corner portions of other end sides (X2 sides) and also on the rear sides (Y2 sides) within the first block 84A and the fourth block 84D. However, in case of providing the curved portion 841 for the respective blocks 84, it is allowed to provide curved portions 841 at any other corner portions other than those above.

Figure 7:
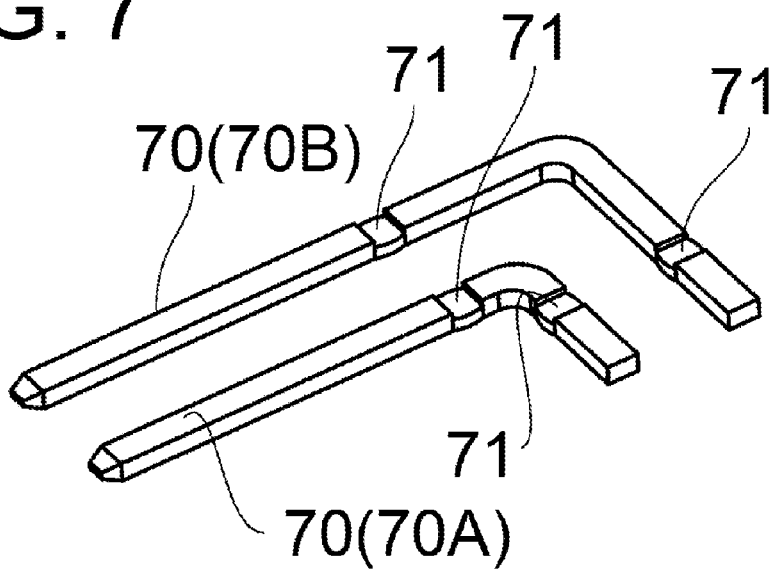
FIG. 7 is a perspective view showing a constitution of a terminal member within the antenna device of FIG. 1.

Into such mounting grooves 81, there are plugged-in the terminal members 70 as shown in FIG. 7 and it becomes a plug-in state as shown in the FIGS. 3 and 6. As shown in FIG. 7, the terminal member 70 of the present exemplified embodiment is a member which was formed in an approximate L-shape by applying a press-molding with respect to a metal-made terminal. However, it is allowed to employ a configuration in which a terminal member 70 having a straight shape which is not an approximate L-shape is inserted into the first mounting horizontal-groove 82A or into the second mounting horizontal-groove 82B and thereafter, is bent by utilizing a jig or a curved portion 841 which will be described later (see Another-Embodiment No. 1).

For such a terminal member 70, there is provided a wide portion 71 formed by pressing force when pressed. The wide portions 71 is provided so as to become wider a little bit compared with the respective mounting grooves 81 and exists on the respective sides of the terminal member 70 having an approximate L-shape (that is, total two wide portions exist) in the constitution shown in FIG. 7. In addition, the wide portions 71 are formed by pressing force when pressed and therefore, are provided to be thinner than the other portions of the terminal member 70.

This wide portion 71 is a portion which is hooked on the side wall of the mounting groove 81 when plugging-in the terminal member 70 into the mounting groove 81 (this plugging-in corresponds to the terminal mounting process). For this reason, a constitution can be obtained in which when plugging-in the terminal member 70 into the mounting grooves 81, it is difficult for the terminal member 70 to be pulled out from the mounting groove 81. It should be noted that it is allowed to form the widths of the terminal member 70 other than the widths of the wide portions 71 to be a little bit narrower than the width of the mounting groove 81. In case of employing a constitution like this, it becomes more difficult for the terminal member 70, which is plugged-in into the mounting groove 81, to be pulled out.

The above-mentioned terminal member 70 is a member that is formed by, for example, a metal material such as copper (Cu), iron (Fe), nickel (Ni), an alloy thereof or the like, whose electrical conductivity is excellent and also which has a predetermined hardness, having a predetermined diameter and having a circular, elliptical or polygonal cross-section shape, and that is shearing-processed into a predetermined length. Here, it is preferable that on the surface of the terminal member 70, there is formed a plating layer by means of a metal material such as tin, nickel or cobalt, chromium, palladium, gold, copper and the like or by means of an alloy material whose main component is made of those metal materials.

It should be noted from the viewpoint of the processing or the mounting that it is preferable for the terminal member 70 to be a member which has an approximately rectangular cross-sectional shape having long-side and short-side. In addition, in FIG. 6 and the like, there is shown the configuration in which two terminal members 70 are mounted. However, it is allowed for the terminal member 70 to use any number (for example, three or four) (see Another-Embodiment No. 3). However, with regard to two terminal members 70 within the plurality of terminal members 70, either one of the end portion sides becomes the user terminal. In addition, with regard to at least one terminal member 70 within the plurality of terminal members 70, either one of the end portion sides becomes a binding terminal portion (binding terminal portion 70A1 described later is a representative example thereof).

In addition, as shown in FIG. 6, in a case in which the terminal member 70 is plugged-in into the mounting grooves 81, the distal end side and the rear end side of the terminal member 70 thereof are provided to have such lengths as to protrude from the mounting grooves 81 respectively. In the constitution shown in FIG. 6, one terminal member 70 (terminal member 70A) is plugged-in over and across the first mounting horizontal-groove 82A and the first mounting vertical-groove 83A and concurrently, the other terminal member 70 (terminal member 70B) is plugged-in over and across the second mounting horizontal-groove 82B and the second mounting vertical-groove 83B.

Then, one terminal member 70A and the other terminal member 70B protrude from the first mounting horizontal-groove 82A and the second mounting horizontal-groove 82B toward one end side (X1 side) in the longitudinal direction (X-direction) respectively and concurrently, protrude from the first mounting vertical-groove 83A and the second mounting vertical-groove 83B toward the front side (Y1 side) in the width direction (Y-direction). Then, at the portion which protrudes from the first mounting vertical-groove 83A toward the front side (Y1 side) within the terminal members 70A, there is bound the terminal end of the conductive wire 41 (this binding process corresponds to binding process) and there will be achieved a function as a binding terminal. Hereinafter, the portion which functions as this binding terminal will be named as a binding terminal portion 70A1. It should be noted that the end portion on the opposite side of the binding terminal portion 70A1 within the one terminal members 70A becomes a user terminal which will be connected to another device or the like (this is similarly true also with regard to the terminal member 70B).

In addition, the portion which protrudes from the second mounting vertical-groove 83B toward the front side (Y1 side) within the terminal member 70B is overlapped with a lead unit 91 of a pin type capacitor 90 (hereinafter, this portion will be named as a lead overlapping portion 70B1) and these portions are electrically connected by soldering or the like. It should be noted that connection of the both portions is not limited by soldering and it is possible to use a variety of construction methods such as of resistance welding, of laser welding and the like.

It should be noted that the portions which protrude from the first mounting horizontal-groove 82A and the second mounting horizontal-groove 82B toward one end side (X1 side) in the longitudinal direction (X-direction) within one terminal member 70A and the other terminal member 70B are plugged-in into the terminal insertion holes 612 respectively. Then, these protruding portions extend toward the connector hole 621 of the connector connecting portion 62.

In addition, at the fourth block 84D, there is provided a terminal end guide portion 84D1. The terminal end guide portion 84D1 is a portion which guides the terminal end of the conductive wire 41 which is directed to the terminal portion 70A1. For this reason, the terminal end guide portion 84D1 is provided in a wall surface shape to be protruded toward the upper side (Z1 side) compared with the portion on which the conductive wire 41 is placed. In addition, on the other side (X2 side) in the longitudinal direction (X-direction) and also on the rear side (Y1 side) in the width direction (Y-direction) within the terminal end guide portion 84D1, there exists a pin-shaped portion provided to be longer than the wall-surface shaped portion and a configuration is employed in which the guide of the conductive wire 41 can be carried out favorably.

Figure 8:
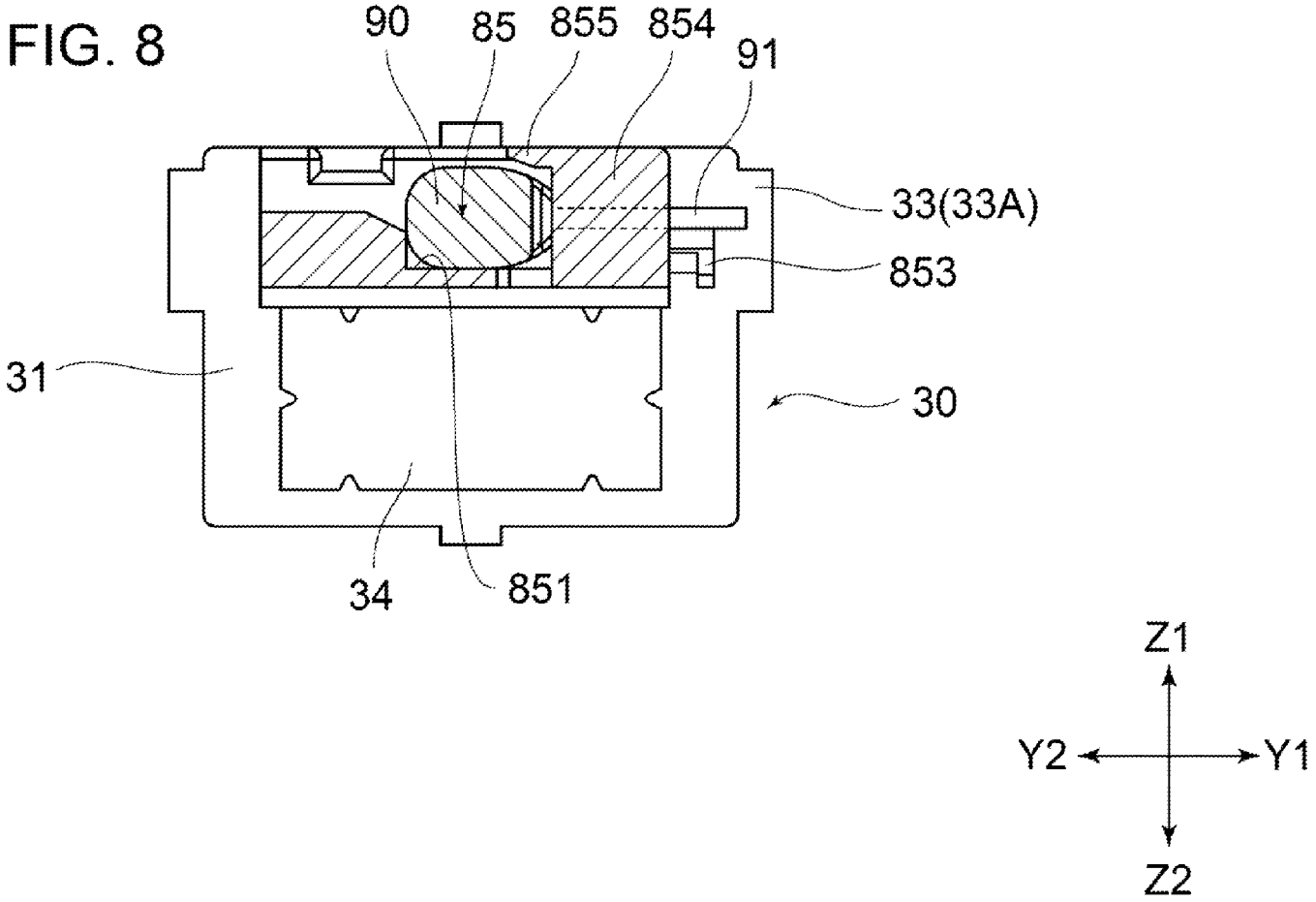
FIG. 8 is a front cross-sectional view showing a constitution in the vicinity of a capacitor mounting portion within the terminal mounting unit in the antenna device of FIG. 1, which shows a state in which a pin type capacitor exists at the capacitor mounting portion.

In addition, in the terminal mounting unit 80, there is provided also a mounting unit 85 for mounting the pin type capacitor 90. FIG. 8 is a front cross-sectional view showing a constitution in the vicinity of the capacitor mounting unit 85 within the terminal mounting unit 80 and shows a state in which the pin type capacitor 90 exists at the capacitor mounting unit 85. As shown in FIG. 8, at the capacitor mounting unit 85, there is provided a recessed concave portion 851 for arrangement in order to arrange the pin type capacitor 90. It should be noted that the lead protruding from one end side (X1 side) in the longitudinal direction (X-direction) within a pair of the lead units 91 is arranged so as to overlap the lead overlapping portion 70B1 of the terminal member 70B in the second mounting vertical-groove 83B and extends toward the front side (Y1 side) in the width direction (Y-direction).

In addition, the other side within the pair of lead units 91 is derived to the front side (Y1 side) in the width direction (Y-direction) through a derivation-groove portion 852. In addition, on the side wall on the lower side (Z2 side) of the derivation-groove portion 852, there is provided a guide convex portion 853 which protrudes toward the direction apart from the terminal mounting unit 80 thereof and the guide convex portion 853 thereof and the distal end side of the lead unit 91 are overlapped. Owing to this configuration, it is made easy to bind the terminal end of the conductive wire 41 around the lead unit 91. It should be noted that also for the electrical connection of the conductive wire 41 and the lead unit 91, it is possible to use a variety of constitution methods such as of soldering, of resistance welding, of laser welding and the like.

In addition, at the capacitor mounting unit 85, there is provided a front-side locking wall 854, and further, a suppress portion 855 extends from the front-side locking wall 854. The front-side locking wall 854 is positioned between the pair of lead units 91 within the pin type capacitor 90 and is a portion which limits the movement of the pin type capacitor 90 toward the front side (Y1 side). In addition, the suppress portion 855 is a portion which is faced to the concave portion 851 for arrangement and prevents the pin type capacitor 90 from dropping out toward the upper side (Z1 side). Therefore, the suppress portion 855 extends from the upper side (Z1 side) of the front-side locking wall 854 toward the rear side (Y2 side) thereof.

Here, in the present exemplified embodiment, there is used the pin type capacitor 90 as mentioned above. In case of using such a pin type capacitor 90, it is possible to exert the following effect. More specifically, it is possible to correct the direction of pulling out the lead unit 91 of the pin type capacitor 90 and therefore, it is possible to pull out the lead unit 91 in accordance with the shape of the terminal mounting unit 80. Owing to this configuration, it is possible to simplify the designing of the terminal mounting unit 80.

In addition, in case of using the pin type capacitor 90, it becomes possible to be correspondence with various kinds of mounting processes of such as soldering or welding the lead unit 91 and the like compared with the case of using a surface-mounting type chip capacitor. Here, it is possible to carry out the mounting process on the outside of the terminal mounting unit 80 by pulling out the lead unit 91 from the derivation-groove portion 852 or the second mounting vertical-groove 83B and therefore, it is possible to reduce damage from the heat generated in the mounting process to the terminal mounting unit 80.

Further, with regard to the pin type capacitor 90, it is possible to simplify the mounting process thereof such as the capacitor is mounted on the above-mentioned concave portion 851 for arrangement or the like when being mounted on the terminal mounting unit 80 compared with the chip capacitor of the surface-mounted type. Owing to this configuration, the cost reduction by simplification of the process is also possible.

It should be noted that the configuration of mounting the terminal member 70 onto the mounting grooves 81 is not to be limited by the configuration described above. For example, it is possible to arrange the conductive wire 41 by being directly wound around the outer circumferential side of the core 20. In this case, it becomes unnecessary to provide the winding-frame portion 32. Hereinafter, there will be explained another embodiments for mounting the terminal members 70 onto the mounting grooves 81.

Another-Embodiment No. 1

Figure 9:
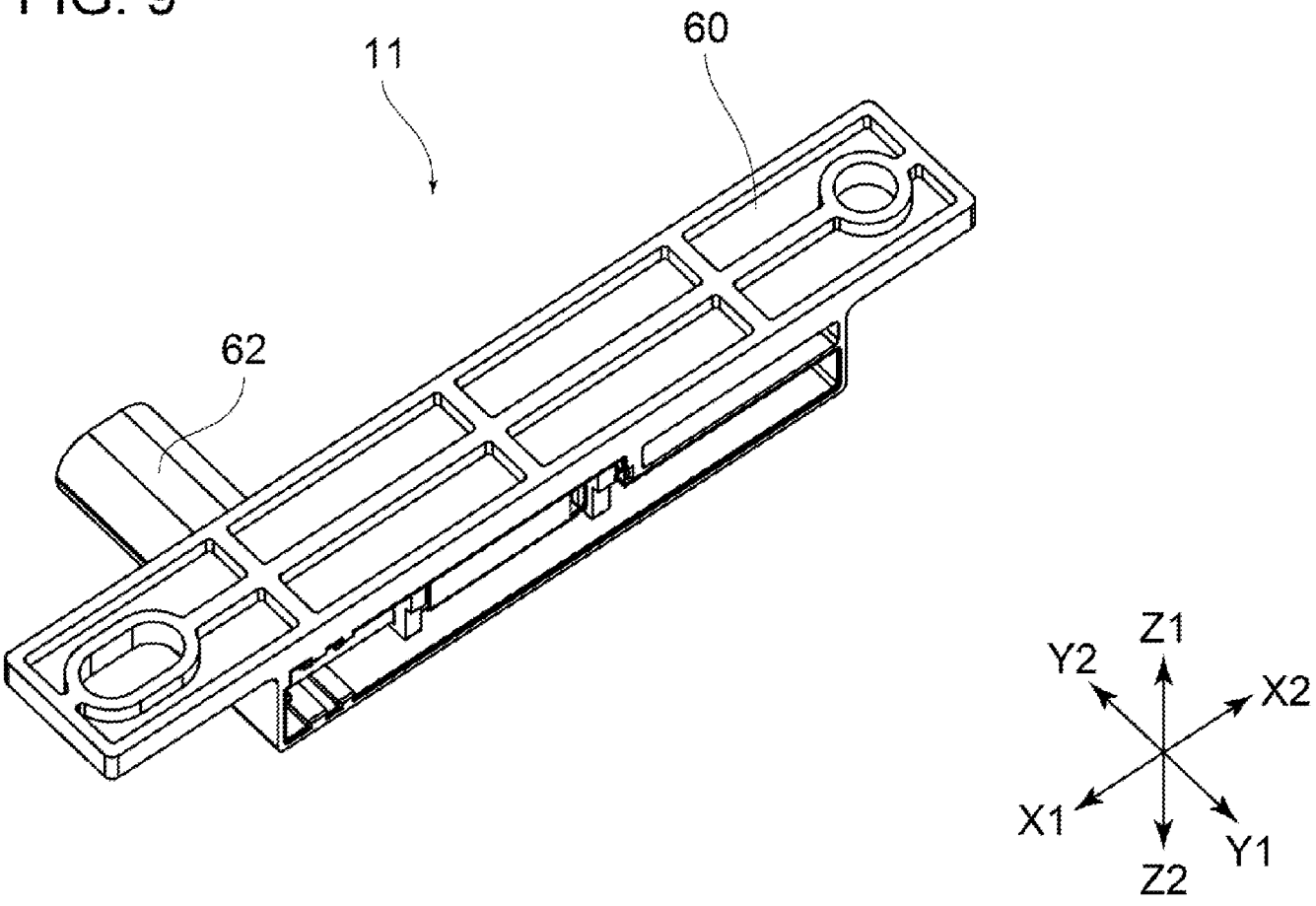
FIG. 9 is a perspective view showing a constitution of an antenna device relating to Another-Embodiment No. 1.
Figure 10:
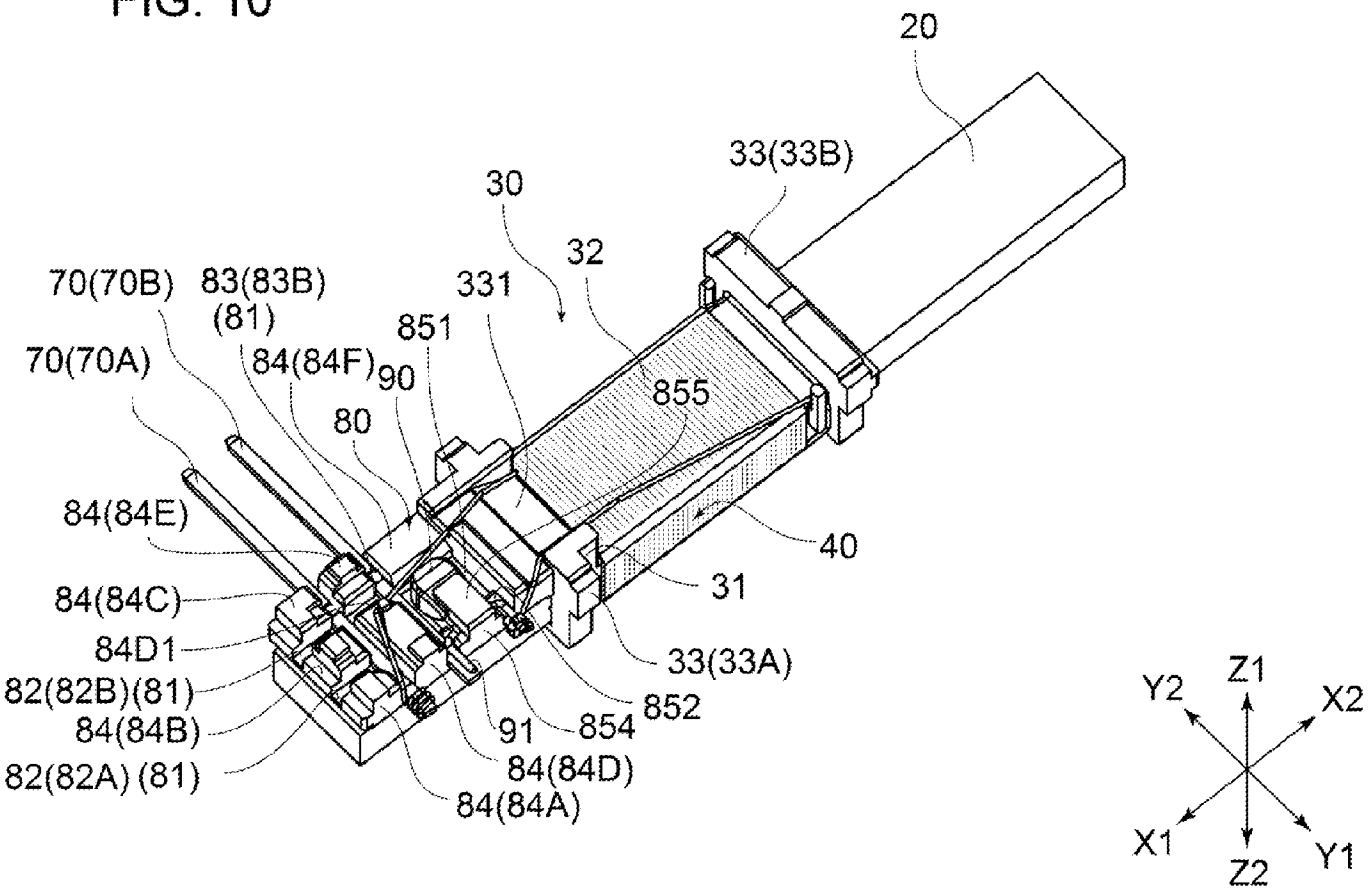
FIG. 10 is a perspective view showing a constitution obtained by removing a case and a resin-filling portion from the antenna device relating to the Another-Embodiment No. 1.

FIG. 9 is a perspective view showing a constitution of an antenna device 11 relating to Another-Embodiment No. 1. FIG. 10 is a perspective view showing a constitution in which the resin-filling portion 50 is removed from the antenna device 11 relating to the Another-Embodiment No. 1. It should be noted in the constitution shown in FIG. 9 that there is shown a state in which the side surface on the front side (Y1 side) of the case 60 is opened, but it is needless to say that the side surface on this front side (Y1 side) can be closed.

As shown in FIGS. 9 and 10, in the Another-Embodiment No. 1, the terminal members 70 are different from those shown in FIG. 7 and are formed in straight shapes. Then, the terminal members 70 of such straight shapes are plugged-in into the first mounting vertical-groove 83A and the second mounting vertical-groove 83B. Caused by the relation in which the terminal members 70 of such straight shapes are plugged-in into the first mounting vertical-groove 83A and the second mounting vertical-groove 83B, the connector connecting portion 62 of the case 60 is provided so as to protrude toward the position corresponding to the rear side (Y2 side) of the terminal members 70.

Another-Embodiment No. 2

Figure 11:
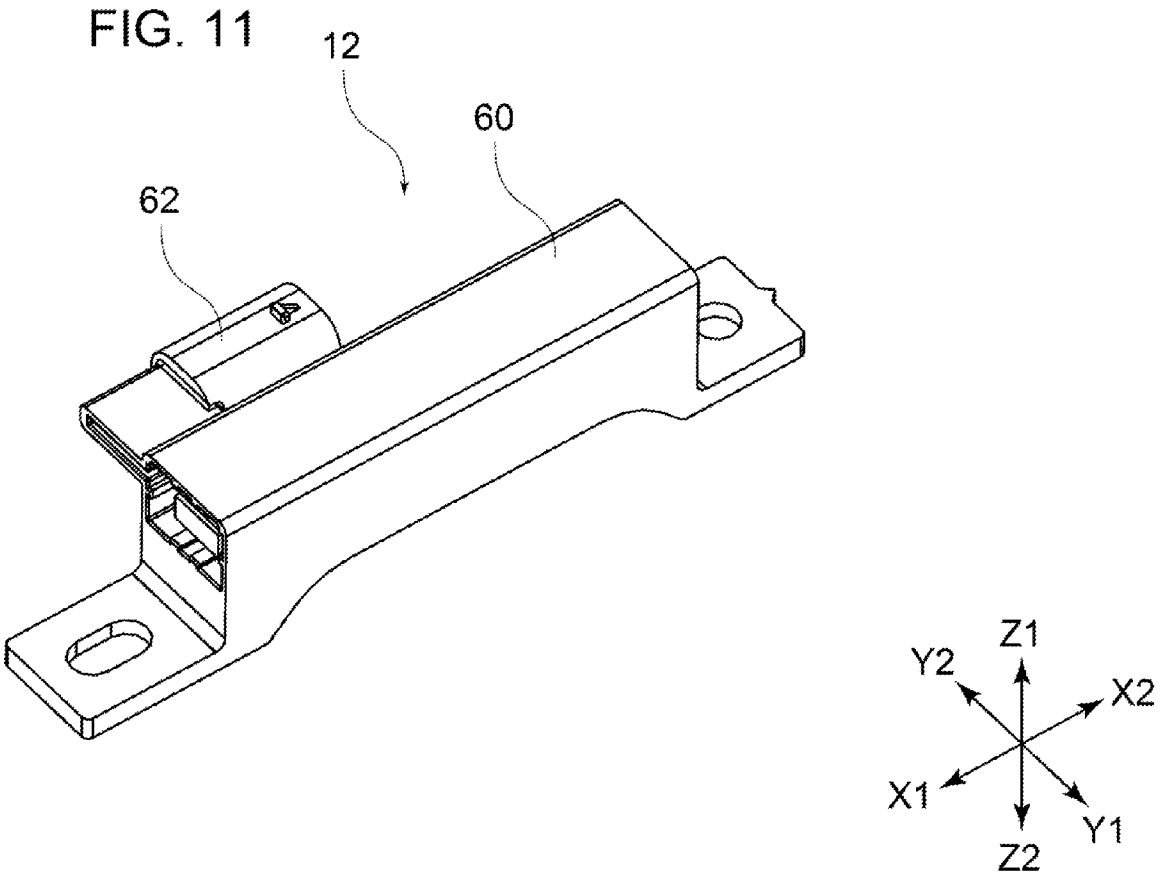
FIG. 11 is a perspective view showing a constitution of an antenna device relating to Another-Embodiment No. 2.
Figure 12:
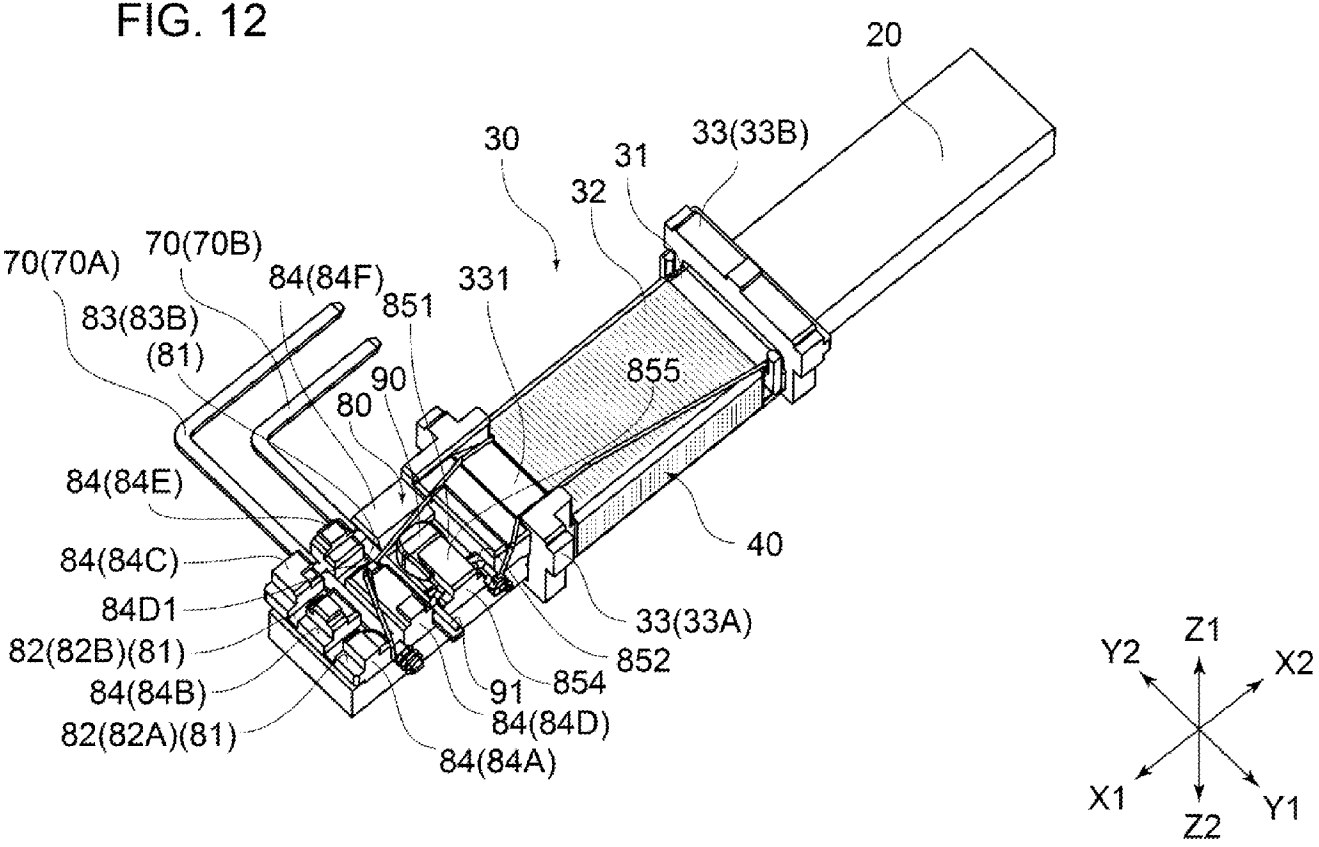
FIG. 12 is a perspective view showing a state obtained by removing a case and a resin-filling portion from the antenna device relating to the Another-Embodiment No. 2.

FIG. 11 is a perspective view showing a constitution of an antenna device 12 relating to Another-Embodiment No. 2. FIG. 12 is a perspective view showing a state in which the resin-filling portion 50 is removed from the antenna device 12 relating to the Another-Embodiment No. 2. It should be noted in FIG. 11 that there is shown a state in which the end surface of one end side (X1 side) in the longitudinal direction (X-direction) is opened, but it is needless to say that the end surface of this one end side (X1 side) can be closed.

As shown in FIG. 12, in the Another-Embodiment No. 2, the terminal members 70 are bent so as to get approximate L-shapes similarly as the terminal members 70 shown in FIG. 7. However, the portions which are plugged-in into the first mounting vertical-groove 83A and the second mounting vertical-groove 83B within the terminal members 70 are constituted to be straight shapes. Then, each of the terminal members 70 is bent on the rear side (Y2 side) so as to be directed to the other end side (X2 side) in the longitudinal direction (X-direction). Caused by the relation in which such approximately L-shaped terminal members 70 are plugged-in into the first mounting vertical-groove 83A and the second mounting vertical-groove 83B, the connector connecting portion 62 of the case 60 protrudes from the position corresponding to the rear side (Y2 side) of the terminal members 70 and concurrently is bent so as to be directed from the position corresponding to the bending of the terminal members 70 on the rear side (Y2 side) toward the other end side (X2 side) in the longitudinal direction (X-direction). More specifically, also the connector connecting portion 62 is provided to be in an approximate L-shape.

Another-Embodiment No. 3

Figure 13:
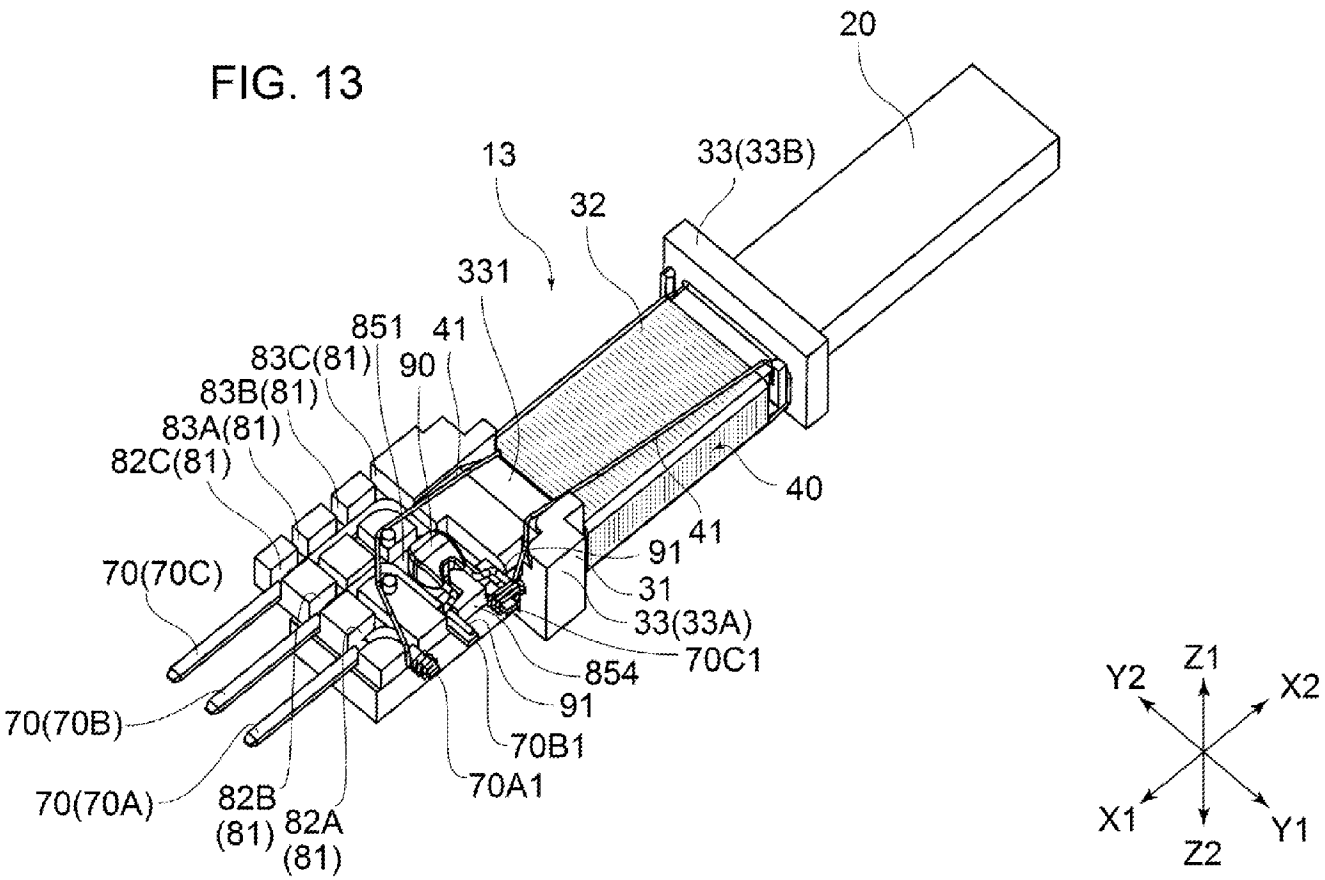
FIG. 13 is a perspective view showing a constitution obtained by removing a case and a resin-filling portion from the constitution of an antenna device relating to Another-Embodiment No. 3.

FIG. 13 is a perspective view showing a constitution obtained by removing the case 60 and the resin-filling portion 50 from the constitution of the antenna device 13 relating to Another-Embodiment No. 3. It should be noted in this Another-Embodiment No. 3 that the constitution of the state of mounting the case 60 and the resin-filling portion 50 is similar to the configuration shown in FIG. 1 which was described above and therefore, the drawing thereof is omitted.

Such an antenna device 13 is formed as an antenna device of three-terminal type in which there are used three terminal members 70. Then, in order to get correspondence with such three terminal members 70, there are provided three mounting horizontal-grooves 82 and likewise three mounting vertical-grooves 83 for the grooves 81 which exist in the terminal mounting unit 80. In the following explanation, with regard to the mounting horizontal-grooves 82, there will be named as a first mounting horizontal-groove 82A, a second mounting horizontal-groove 82B and a third mounting horizontal-groove 82C in this order from the front side (Y1 side) toward the rear side (Y2 side). In addition, with regard to the mounting vertical-grooves 83, there will be named as a first mounting vertical-groove 83A, a second mounting vertical-groove 83B and a third mounting vertical-groove 83C in this order from one end side (X1 side) toward the other end side (X2 side) in the longitudinal direction (X-direction).

It should be noted that the third mounting vertical-groove 83C is provided at a similar position as that of the derivation-groove portion 852 described above. Then, the terminal member 70A within the terminal members 70 is, similarly as the constitution shown in FIG. 6 and the like, plugged-in over and across the first mounting horizontal-groove 82A and the first mounting vertical-groove 83A. In addition, the terminal member 70B is plugged-in over and across the second mounting horizontal-groove 82B and the second mounting vertical-groove 83B. Further, the terminal member 70C is plugged-in over and across the third mounting horizontal-groove 82C and the third mounting vertical-groove 83C.

Then, around the binding terminal portion 70A1 of the terminal member 70A, there is bound a terminal end of the conductive wire 41 as mentioned above and the both thereof are electrically connected each other. In addition, on the lead overlapping portion 70B1 of the terminal member 70B, one lead unit 91 is overlapped and the both thereof are electrically connected each other. In addition, also at the terminal member 70C, there is provided a lead overlapping portion 70C1 and on this lead overlapping portion 70C1, another lead unit 91 is overlapped and concurrently, a terminal end of 41 is wound there-around. Then, the terminal end of the conductive wire 41, the lead unit 91 and the lead overlapping portion 70C1 are electrically connected together.

Figure 14:
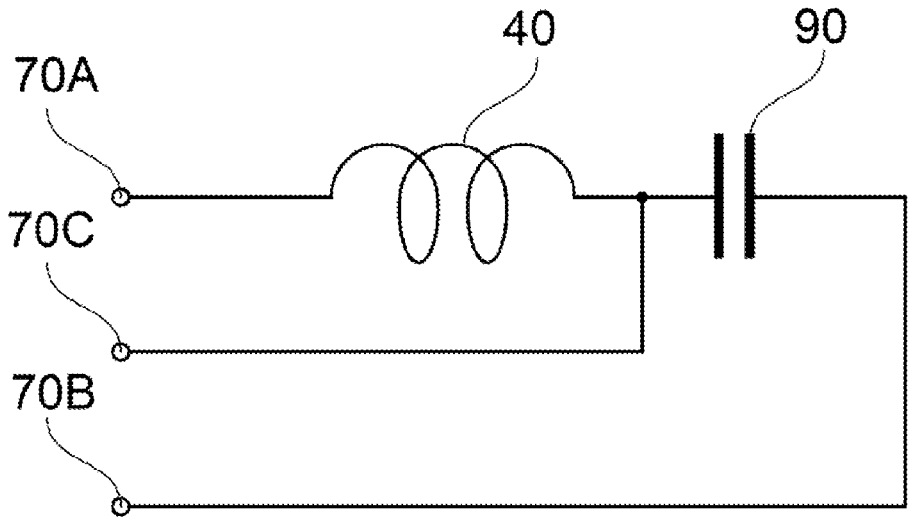
FIG. 14 is a view showing an internal connection circuit which is constituted in the Another-Embodiment No. 3.

Owing to such a connection, in the antenna device 13, there is constituted an internal connection circuit as shown in FIG. 14. It should be noted in such a three-terminal type antenna device 13 that based on the circuit specification of the target device (including vehicle) on which that antenna device 13 is to be mounted, it becomes possible to realize an LC-series oscillation circuit, an oscillation circuit constituted only by an L-element, an LC-parallel oscillation circuit or the like freely by selecting the mounting terminal member 70 and the circuit element to be connected to that terminal member 70. Therefore, with regard to the antenna device 13, the versatility as an antenna device becomes much higher.

Figure 15:
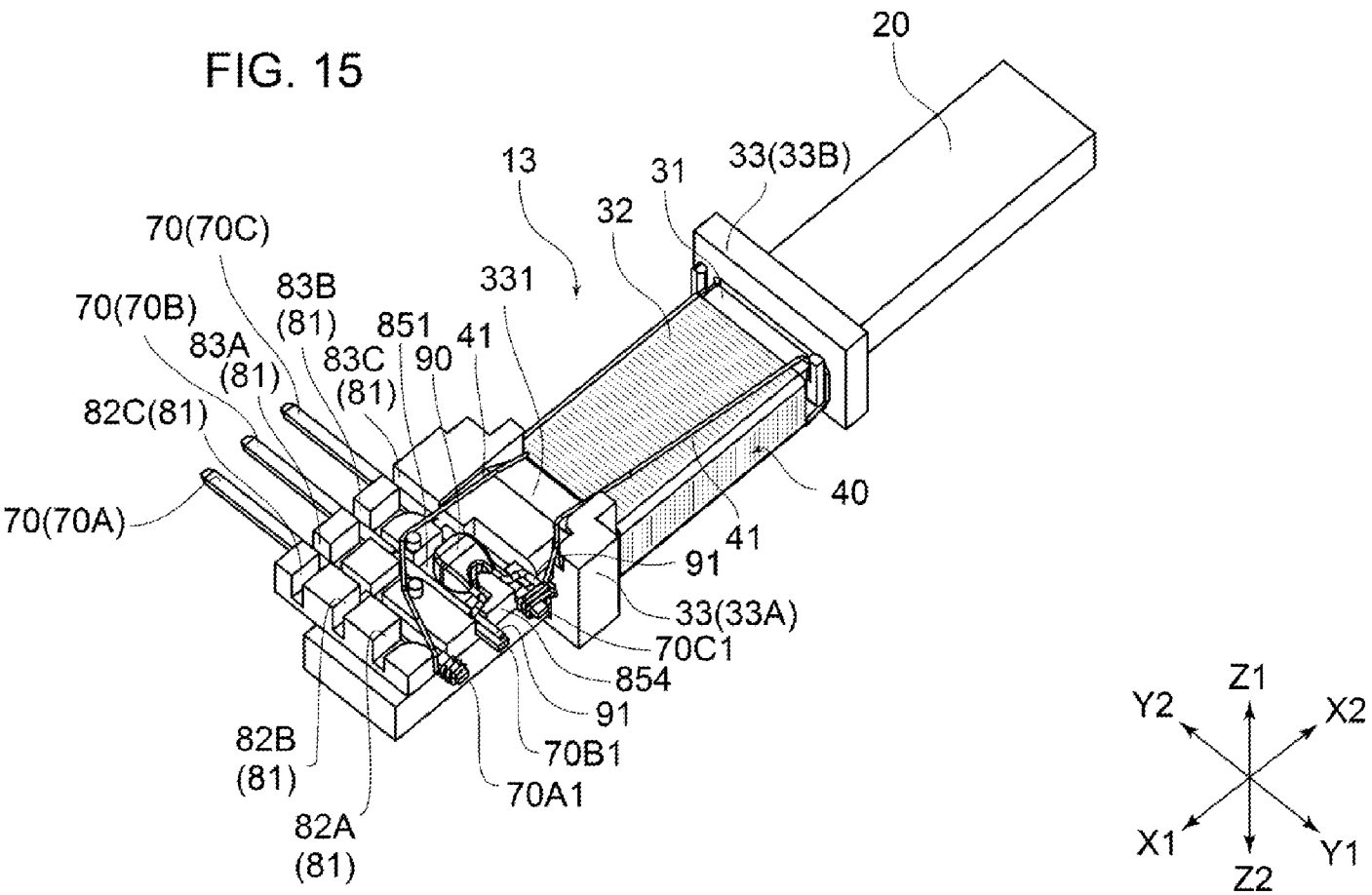
FIG. 15 relates to a modified example of the Another-Embodiment No. 3 and is a perspective view showing a state in which straight-shaped terminal members are plugged-in into respective mounting vertical-grooves.
Figure 16:
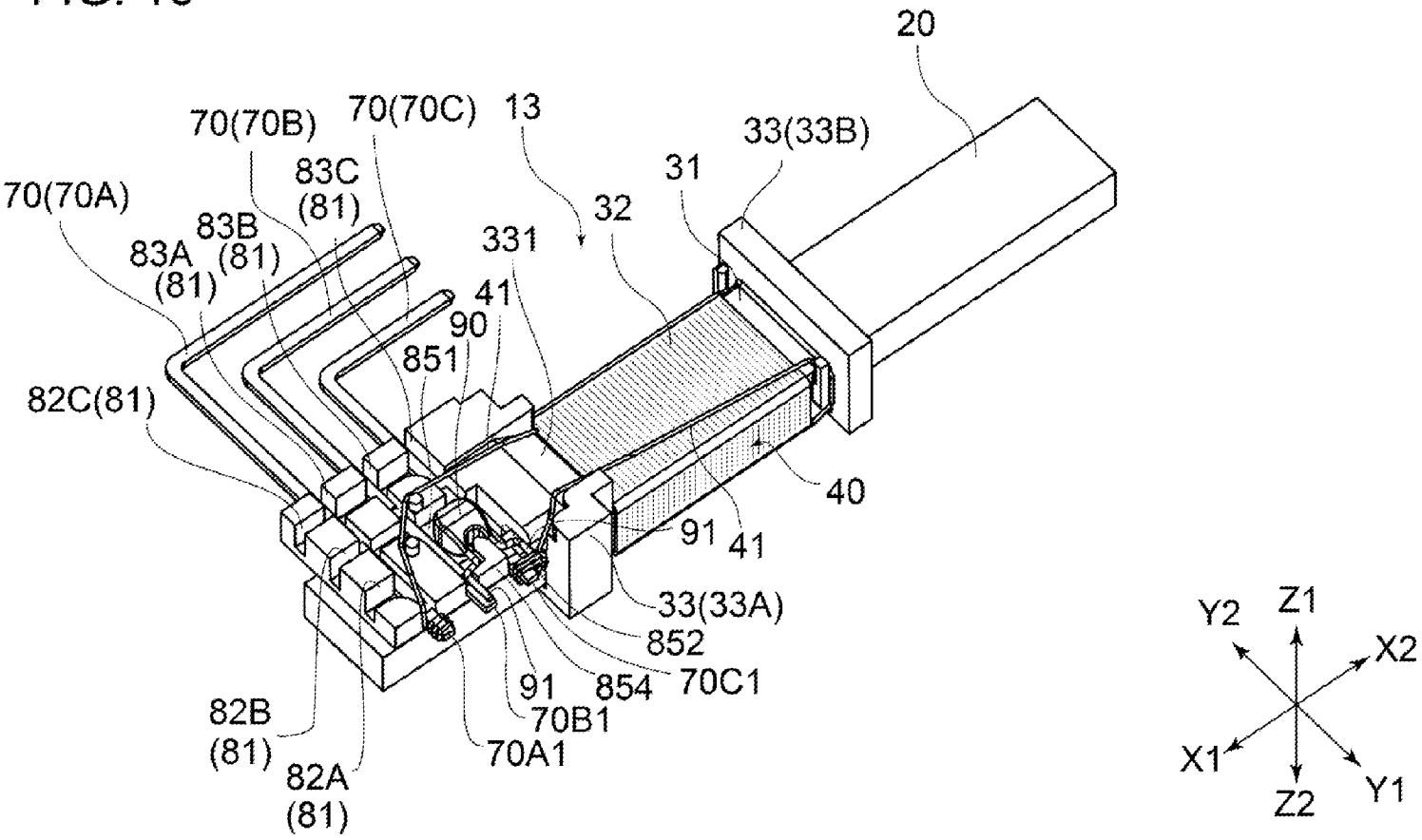
FIG. 16 relates to a modified example of the Another-Embodiment No. 3 and is a perspective view showing a state in which approximately L-shaped terminal members are used.

It should be noted that modified examples of the Another-Embodiment No. 3 are shown in FIGS. 15 and 16. FIG. 15 shows a state in which straight shaped terminal members 70 (terminal members 70A to 70C) as shown in FIG. 10 are plugged-in into the first mounting vertical-grooves 83A to 83C respectively. In addition, FIG. 16 is a view showing a state in which there are used approximately L-shaped terminal members 70 (terminal members 70A to 70C) as shown in FIG. 12. It should be noted in FIG. 16 that the approximately L-shaped terminal members 70 (terminal members 70A to 70C) are plugged-in into the first mounting vertical-grooves 83A to 83C respectively. However, within the approximately L-shaped terminal members 70 (terminal members 70A to 70C), the portions which are plugged-in into the first mounting vertical-grooves 83A to 83C are constituted to be straight-shaped portions for the respective terminal members 70A to 70C.

Another-Embodiment No. 4

Figure 17:
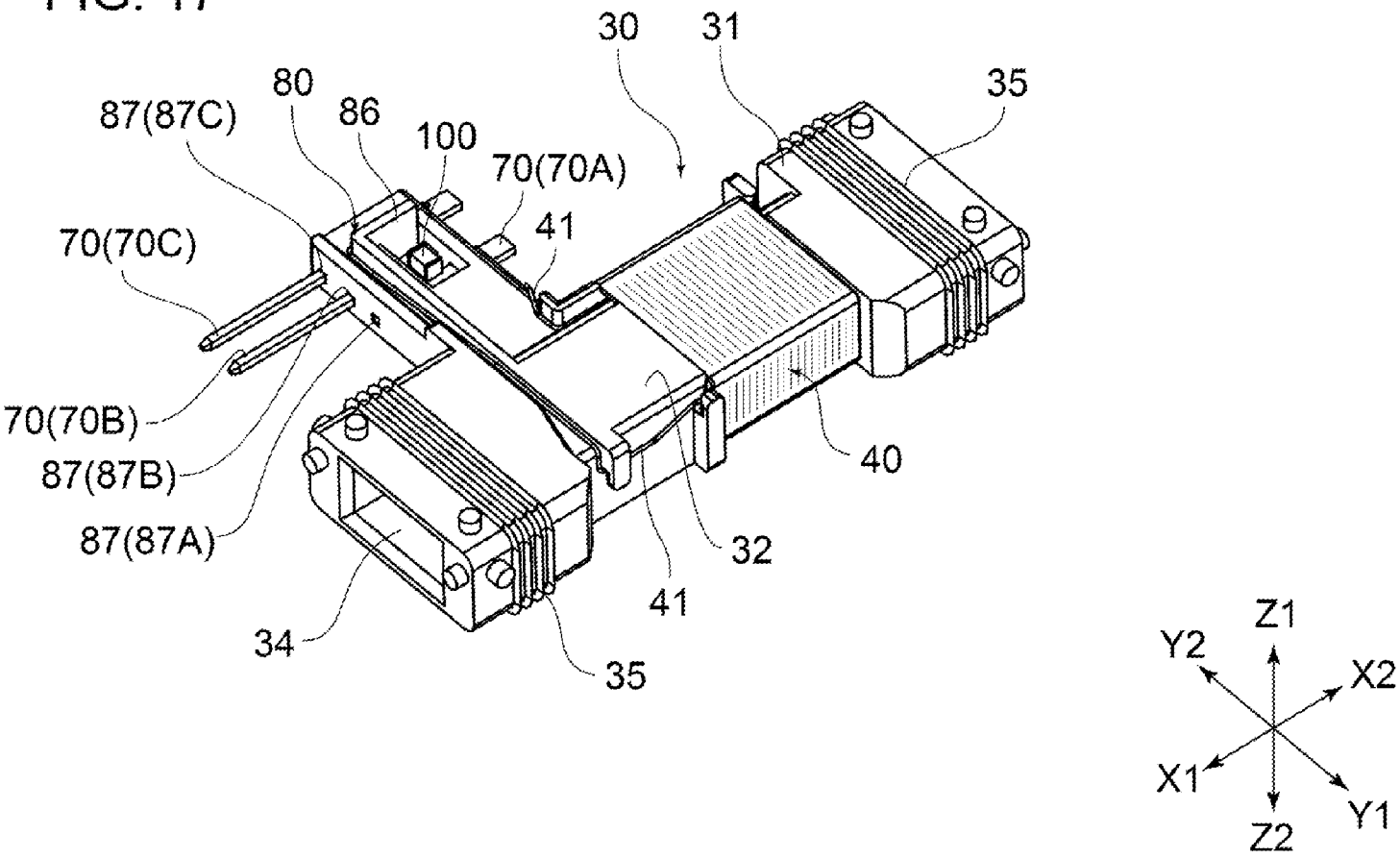
FIG. 17 relates to an antenna device relating to Another-Embodiment No. 4 and is a perspective view showing a constitution obtained by removing a case and a resin-filling portion from the constitution of the antenna device thereof.

FIG. 17 relates to an antenna device 14 relating to Another-Embodiment No. 4 and is a perspective view showing a constitution in which the case 60 and the resin-filling portion 50 are removed from the constitution of that antenna device 14. It should be noted in this Another-Embodiment No. 4 that the constitution of the state of mounting the case 60 and the resin-filling portion 50 is similar to the configuration shown in FIG. 1 which was described above and therefore, the drawing thereof is omitted.

The base 30 of the Another-Embodiment No. 4 has the cylinder portion 31 as described above and for that cylinder portion 31, there is provided an internal insertion-hole 34 into which the core 20 is inserted. In addition, for the cylinder portion 31, there is arranged the coil 40 which is constituted by the winding of the conductive wire 41. However, in the Another-Embodiment No. 4, for the base 30, there exist fins 35 instead of the supporting flange portion 33. The fins 35 are provided by a plurality of members (four members for each one in FIG. 17) and these fins 35 abut the inner wall of the plug-in hole 61 of the case 60. Owing to this configuration, the plug-in hole 61 is sealed from the outside.

Figure 18:
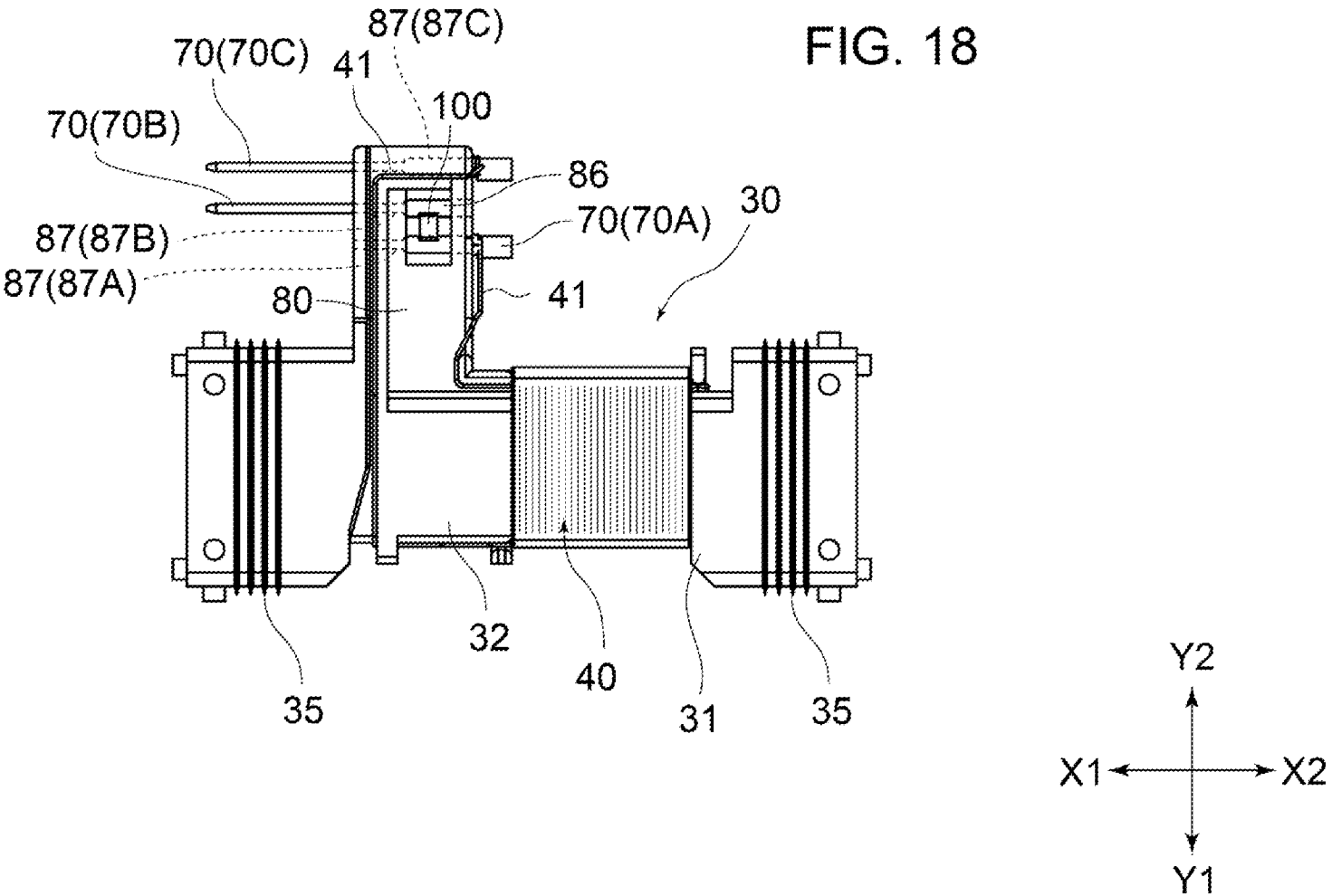
FIG. 18 is a plan view showing a constitution of a terminal mounting unit of the antenna device in the Another-Embodiment No. 4.

In addition, the terminal mounting unit 80 is provided by being protruded from the side surface of the rear side (Y2 side) of the cylinder portion 31 toward more rear side (Y2 side). FIG. 18 is a plan view showing a constitution of the terminal mounting unit 80. As shown in FIGS. 17 and 18, for the terminal mounting unit 80, there is provided an opening portion 86. The opening portion 86 penetrates the terminal mounting unit 80 along the up and down directions (Z-direction). At this opening portion 86, there is arranged a chip capacitor 100 of SMD (Surface Mount Device) type.

In addition, for the terminal mounting unit 80, there are provided a number of terminal insertion holes 87 corresponding to the number of the terminal members 70. It should be noted that the terminal insertion holes 87 correspond to the terminal plugging-in units. The terminal insertion hole 87C on the most rear side (Y2 side) within the plurality of terminal insertion holes 87 does not reach the opening portion 86. However, the terminal insertion holes 87A, 87B for plugging-in the two terminal members 70A, 70B, which are positioned on the front side (Y1 side), reach the opening portion 86. More specifically, the hole opening portions of the terminal insertion holes 87A, 87B are exposed in the opening portion 86.

It should be noted that the terminal insertion holes 87A, 87B are constituted in a state of being divided into two in the opening portion 86. In this configuration, the terminal insertion holes 87A, 87B which are positioned on the other end side (X2 side) seen from the opening portion 86 are provided so as to have large aperture areas, but the terminal insertion holes 87A, 87B which are positioned on one end side (X1 side) are provided so as to have small aperture areas. Owing to this configuration, the plugging-in of the terminal members 70A, 70B which are plugged-in into the terminal insertion holes 87A, 87B from the other end side (X2 side) toward one end side (X1 side) is to be regulated.

Figure 19:
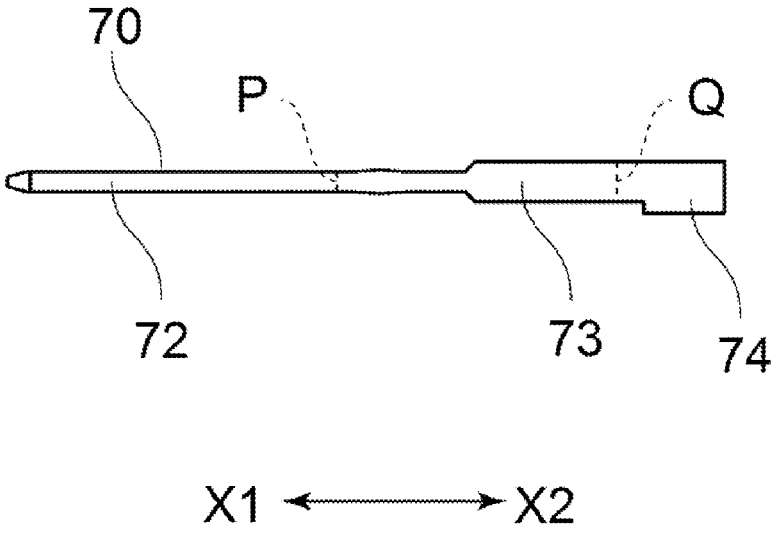
FIG. 19 is a plan view showing a shape of the terminal member which is used in the Another-Embodiment No. 4.

FIG. 19 is a plan view showing a shape of the terminal member 70. As shown in FIG. 19, the terminal member 70 is provided with a narrow pin-shaped portion 72, a wide support portion 73 and an outward wide portion 74, in which those elements are provided continuously. Then, the wide support portion 73 is wider than the narrow pin-shaped portion 72 and also, the outward wide portion 74 is provided widely compared with the support portion 73. It should be noted in FIG. 19 that also cut lines P, Q are shown therein. When cutting the terminal member 70 shown in FIG. 19 along the cut line P, there can be formed a terminal member 70A which is positioned at the most front side (X1 side). In addition, when cutting the terminal member 70 shown in FIG. 19 along the cut line Q, can be formed a terminal member 70B which is adjacent to the terminal member 70A. It is allowed for the cutting-off of the terminal members 70 along such cut lines P, Q to be carried out after the insertions of the terminal members 70 into the terminal insertion holes 87A, 87B (carried out in correspondence to the cutting process) and it is allowed to be carried out before the insertions of the terminal members 70 into the terminal insertion holes 87A, 87B.

In addition, after the terminal members 70A, 70B are inserted into the terminal insertion holes 87A, 87B respectively, the chip capacitor 100 is supported by the wide support portions 73 and the chip capacitor 100 thereof is electrically connected with respect to the respective wide support portions 73 by soldering or by another method.

In addition, the outward wide portion 74 of the terminal member 70A and the outward wide portion 74 of the terminal member 70C are bound with the conductive wires 41 respectively and those elements are electrically connected.

It should be noted in this Another-Embodiment No. 4 that there is shown a manufacturing method in which the terminal insertion holes 87 are integrally molded with the base 30 and thereafter, the terminal member 70 is inserted there-into. However, it is possible to carry out the manufacturing by a method of not providing the terminal insertion holes when molding the base 30. In this case, it is possible to take procedures in which first, the base 30 without the existence of the terminal insertion holes is formed by an injection-molding method and thereafter, the terminal insertion holes 87 are formed while inserting the terminal members 70 into predetermined positions of the base 30 by using an automatic terminal-pin insertion machine.

With Regard to the Effects

According to the antenna device 10 having such a constitution as described above, there are provided a plurality of mounting grooves 81 for the terminal mounting unit 80 and terminal members 70 are plugged-in into the mounting grooves 81 thereof. Therefore, it becomes possible to mount the terminal members 70 simply without employing insert-molding. Therefore, it becomes unnecessary to use a mold for carrying out the insert-molding and it is possible to simplify the process thereof. In addition, since it becomes unnecessary to carry out the insert-molding, it becomes possible to reduce the cost.

In addition, it becomes possible to plug-in the terminal member 70 by selecting a desired mounting groove 81 from the plurality of mounting grooves 81 and it becomes possible to easily change the mounting configuration of the terminal member 70. Owing to this aspect, it becomes possible to improve the mounting flexibility of the terminal member 70. More specifically, it also becomes possible to take correspondence with a huge variety of specifications from the customers.

Here, in case of changing the mounting configuration of the terminal member 70 for the constitution of the past technology, it becomes necessary to newly produce a mold for insert-molding corresponding to the change thereof. However, according to the present exemplified embodiment, it is possible, only by using the same base 30 and concurrently by selecting the mounting groove 81 on which the terminal member 70 is to be mounted from the base 30 thereof, to easily change the mounting configuration of the terminal member 70. Therefore, it becomes unnecessary to newly produce a mold for insert-molding, it becomes possible to simplify the process, and concurrently, it becomes possible to reduce the cost.

In addition, according to the present exemplified embodiment, each of the antenna devices 10 to 14 is further provided with the winding-frame portion 32 which is integrally molded with the terminal mounting unit 80. In addition, the core 20 is inserted into the internal insertion-hole 34 of the winding-frame portion 32 and the core 20 is arranged on the outer circumferential side of the winding-frame portion 32. For this reason, it becomes possible to form the coil 40 on the winding-frame portion 32 and there can be obtained a constitution in which the coil 40 is not directly formed on the core 20. Therefore, compared with a case in which the coil 40 is directly formed at the outer circumference of the core 20, it is possible to easily carry out the formation of the coil 40 depending on the winding of the conductive wire 41 and the work of binding the terminal end of the conductive wire 41 around the binding terminal portion 70A1 of the terminal member 70 after the formation of the coil 40.

In addition, in the present exemplified embodiment, the plurality of mounting grooves 81 are provided in concave shapes and these concave shaped mounting grooves 81 are crossing with other mounting grooves 81. Therefore, it is possible to improve the arrangement-flexibility of the terminal member 70 furthermore. In addition, at the positions at which the mounting grooves 81 mutually cross, it also becomes possible to arrange the terminal members 70 in bent states corresponding to the intersections thereof and it is possible to improve the flexibility of the pulling-out directions of the terminal members 70.

Further, in the present exemplified embodiment, for the mounting grooves 81, there are provided a plurality of mounting vertical-grooves 83 which pass through the aimed terminal mounting unit 80 along the width direction (Y-direction) of the terminal mounting unit 80 and a plurality of mounting horizontal-grooves 82 which extend along the direction (for example, X-direction) which crosses the width direction (Y-direction) of the terminal mounting unit 80. Therefore, it becomes possible to variously select the length of the mounting terminal member 70 and the direction or position through which the terminal member 70 is pulled out, and it is possible to improve the mounting-flexibility of the terminal member 70 furthermore.

In addition, in the present exemplified embodiment, the mounting vertical-grooves 83 and the mounting horizontal-grooves 82 cross one another in orthogonal states. For this reason, it is possible to distribute the pulling-out directions of terminal members 70 among various directions. For example, it becomes possible to design the pulling-out direction of the terminal member 70 to be on the side surface side or on the front surface side with respect to the terminal mounting unit 80.

Further, in the present exemplified embodiment, for at least one of the positions at which the mounting grooves 81 mutually cross, there is provided a curved portion 841 corresponding to the bending-shape of the terminal member 70. For this reason, also with regard to the terminal member 70 having a bending portion such as, for example, of an approximate L-shape or the like, it becomes possible to mount the member on the mounting grooves 81 favorably.

In addition, in the present exemplified embodiment, with regard to two members within the plurality of the terminal members 70, one member side thereof is a user terminal connected to another device and concurrently, the other member side thereof is a binding terminal portion 70A1 around which the terminal end of the conductive wire is bound. Therefore, it becomes possible to apply connections to a wide variety of devices such as other electric apparatuses, connectors and the like through the user terminal. In addition, it becomes possible to bind the terminal end of the conductive wire 41 around the terminal portion 70A1.

Further, as explained in the Another-Embodiment No. 4, it is also possible, in the present exemplified embodiment, to employ a constitution in which terminal insertion holes 87 are formed in the terminal mounting unit 80. Also in this case, it becomes possible to mount the terminal member 70 on the terminal mounting unit 80 without employing insert-molding. Owing to this configuration, it becomes unnecessary to use a mold for carrying out the insert-molding and it is possible to simplify the process. In addition, it becomes unnecessary to employ insert-molding and it is possible to realize also simplification of a mold used for the formation of the base 30 and therefore, it becomes possible to reduce the cost.

In addition, as explained in the Another-Embodiment No. 4, for the terminal mounting unit 80 in the present exemplified embodiment, there is provided the opening portion 86 and concurrently there is arranged the chip capacitor 100 of surface-mounted type. Then, for the terminal member 70, there is provided the wide support portion 73 which supports the chip capacitor 100 and concurrently which has a wider width compared with the distal end side for the plug-in into the terminal insertion hole 87. Therefore, in the opening portion 86, it is possible to employ a constitution in which the chip capacitor 100 is supported by the wide support portion 73. In addition, by means of soldering or another technical method, it becomes possible to mount the chip capacitor 100 on the wide support portion 73 easily.

In addition, in the present exemplified embodiment, it is also possible to take a procedure in which the terminal members 70A, 70B are to be cut after plugging-in the terminal members 70A, 70B into the terminal insertion holes 87A, 87B respectively y. In case of obtaining the constitution in this manner, it becomes possible to realize the cutting-off in conformity with the insertion lengths or the insertion positions of the terminal members 70A, 70B.

Modified Example

As described above, there was explained one exemplified embodiment of the present invention, but the present invention is configured such that it is possible to employ various kinds of modifications other than that embodiment. Hereinafter, this matter will be described.

In the above-mentioned exemplified embodiment, the pin type capacitor 90 is mounted on the same side as the side on which there exist the mounting grooves 81 within the terminal mounting unit 80 (on the Z1 side surface). However, it is allowed to employ a constitution in which the pin type capacitor is not mounted on the surface on the same side as the mounting grooves 81 but is mounted on the surface on the opposite side with respect thereto (on the Z2 side surface).

In addition, in the above-mentioned exemplified embodiment, there was explained a case in which the pin type capacitor 90 is used for the aimed capacitor. However, even in case of using such a pin type capacitor 90, it is allowed to use a capacitor of surface-mounted type instead of the pin type capacitor 90. It should be noted that in case of using, for example, a chip capacitor of SMD (Surface Mount Device) type, it is possible to use not two of but three of terminal members 70. In that case, it is possible to use a third other terminal member 70 for binding the mounted electrode of the chip capacitor and the terminal end of the conductive wire 41. It should be noted that in case of using such a chip capacitor, it is preferable to employ a constitution in which there is provided a wide portion for the terminal member 70 in order to increase the contact area between that chip capacitor and the terminal member 70.

In addition, in the above-mentioned exemplified embodiment, it is allowed to employ the following constitutions in order to make it more difficult for the terminal member 70 to be pulled out. More specifically, shallow concave portions are to be provided at the bottom portions of the respective mounting grooves 81 and by pushing-in the terminal members 70 toward the concave portions thereof by using a jig or the like, the terminal members 70 are deformed so as to fit into the shallow concave portions. By applying such deformations, it becomes more difficult for the terminal members 70 to be pulled out. In addition, without providing the shallow concave portions, it is allowed to employ a constitution in which it becomes difficult for the terminal members 70 to be pulled out from the mounting grooves 81 only by deforming the terminal members 70 after being forcibly pushed into the mounting grooves 81.

In addition, in the above-mentioned exemplified embodiment, two terminal members 70 are pulled out toward the same direction. However, it is allowed for the two terminal members 70 to be pulled out toward different directions respectively.

In addition, in the above-mentioned exemplified embodiment, there is exemplified a terminal member 70 which is constituted by a hoop member. However, the terminal member is not limited by the hoop member and it is also possible to use, for example, a pin type metal terminal. It should be noted that it is also possible to combine the terminal member 70 of the hoop member and the pin type metal terminal.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. An antenna device comprising:

a core formed from a magnetic material;

a terminal mounting unit arranged on one end portion side of the core, the terminal mounting unit having a plurality of grooves;

a coil which is arranged on an outer circumferential side of the core, the coil being formed by winding a conductive wire, the coil being provided adjacent to the terminal mounting unit; and a plurality of terminals which are mounted in the plurality of grooves of the terminal mounting unit, a first terminal of the plurality of terminals being electrically connected with a first terminal end of the conductive wire, a second terminal of the plurality of terminals being electrically connected with an electronic component, wherein the electronic component is provided on the terminal mounting unit, and wherein at least a first groove of the plurality of grooves crosses a second groove of the plurality of grooves.

2. The antenna device according to claim 1 further comprising:

a winding-frame which is integrally molded with the terminal mounting unit;

wherein the core is inserted into an internal insertion-hole of the winding-frame, and the coil is arranged on an outer circumferential side of the winding-frame.

3. The antenna device according to claim 1, wherein the plurality of grooves are configured with a plurality of mounting vertical-grooves which pass through the terminal mounting unit along a width direction of the terminal mounting unit and a plurality of mounting horizontal-grooves which extend along a direction crossing the width direction of the terminal mounting unit.

4. The antenna device according to claim 3, wherein the plurality of mounting vertical-grooves and the plurality of mounting horizontal-grooves orthogonally cross to each other.

5. The antenna device according to claim 1, wherein at least one of positions at which the plurality of grooves mutually cross is configured by a curved portion corresponding to a bending-shape of one of the plurality of terminals.

6. The antenna device according to claim 1, wherein one end of the first terminal is a user terminal connected to another device, and the other end of the first terminal is a binding terminal portion around which the first terminal end of the conductive wire is bound.

7. The antenna device according to claim 1, wherein a second end of the conductive wire is electrically connected with the electronic component.

8. The antenna device according to claim 1, wherein the electronic component is a capacitor.

9. An antenna device comprising:

a core formed from a magnetic material;

a terminal mounting unit arranged on one end portion of the core, the terminal mounting unit having a plurality of insertion holes;

a coil which is arranged on an outer circumferential side of the core, the coil being formed by winding a conductive wire, the coil being provided adjacent to the terminal mounting unit; and a plurality of terminals which are inserted into the plurality of insertion holes of the terminal mounting unit, a first terminal of the plurality of terminals being electrically connected with a first terminal end of the conductive wire, the first terminal being inserted into a first insertion hole of the plurality of insertion holes, wherein both ends of the first terminal outwardly project from the first insertion hole of the terminal mounting unit in a plan view, wherein the terminal mounting unit has an opening portion penetrating the terminal mounting unit, wherein an electronic component is provided in the opening portion, and wherein a second terminal of the plurality of terminals has a first wide support portion which supports the electronic component, and a width of the first wide support portion is wider than a width of a distal end of the second terminal.

10. The antenna device according to claim 9, wherein the second terminal is inserted into second and third insertion holes of the plurality of insertion holes, and the second and third insertion holes are located adjacent to each other via the opening portion in the plan view, one end of the second terminal outwardly projects from the second insertion hole, and the other end of the second terminal is enclosed in the third terminal insertion hole.

11. The antenna device according to claim 10, wherein a third terminal of the plurality of terminals has a second wide support portion which supports the electronic component, the third terminal is inserted into fourth and fifth insertion holes of the plurality of insertion holes, the fourth and fifth insertion holes are located adjacent to each other via the opening portion in the plan view, and a width of the second wide support portion is wider than a width of a distal end of the third terminal, one end of the third terminal is enclosed in the fourth insertion hole, and the other end of the third terminal outwardly projects from the fifth insertion hole.

12. The antenna device according to claim 11, wherein the other end of the third terminal is electrically connected with a second terminal end of the conductive wire.

13. The antenna device according to claim 9, wherein a third terminal of the plurality of terminals has a second wide support portion which supports the electronic component, the third terminal is inserted into fourth and fifth insertion holes of the plurality of insertion holes, the fourth and fifth insertion holes are located adjacent to each other via the opening portion in the plan view, and a width of the second wide support portion is wider than a width of a distal end of the third terminal, one end of the third terminal is enclosed in the fourth insertion hole, and the other end of the third terminal outwardly projects from the fifth insertion hole.

14. The antenna device according to claim 13, wherein the other end of the third terminal is electrically connected with a second terminal end of the conductive wire.

15. The antenna device according to claim 9, wherein the electronic component is a capacitor.

* * * * *